US010837159B2

(12) United States Patent
Ishihara et al.

(10) Patent No.: US 10,837,159 B2
(45) Date of Patent: Nov. 17, 2020

(54) CONSTRUCTION MACHINE

(71) Applicant: Hitachi Construction Machinery Co., Ltd., Tokyo (JP)

(72) Inventors: Shinji Ishihara, Tokyo (JP); Shinya Imura, Tsuchiura (JP); Shinji Nishikawa, Tsuchiura (JP); Hiroaki Amano, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 301 days.

(21) Appl. No.: 16/084,867

(22) PCT Filed: Sep. 6, 2017

(86) PCT No.: PCT/JP2017/032162
§ 371 (c)(1),
(2) Date: Sep. 13, 2018

(87) PCT Pub. No.: WO2018/061688
PCT Pub. Date: Apr. 5, 2018

(65) Prior Publication Data

US 2019/0055716 A1 Feb. 21, 2019

(30) Foreign Application Priority Data

Sep. 30, 2016 (JP) ..... 2016-194211

(51) Int. Cl.
*E02F 9/22* (2006.01)
*E02F 9/20* (2006.01)

(52) U.S. Cl.
CPC ..... *E02F 9/2292* (2013.01); *E02F 9/20* (2013.01); *E02F 9/2004* (2013.01);
(Continued)

(58) Field of Classification Search
CPC ..... E02F 9/2292; E02F 9/20; E02F 9/2004; E02F 9/2037; E02F 9/2041; E02F 9/22
See application file for complete search history.

(56) References Cited

U.S. PATENT DOCUMENTS

2008/0164832 A1* 7/2008 Kawaguchi ..... E02F 9/2296 318/456
2008/0317574 A1* 12/2008 Moriya ..... E02F 9/128 414/687

(Continued)

FOREIGN PATENT DOCUMENTS

EP 2 653 621 A1 10/2013
EP 2 672 025 A1 12/2013

(Continued)

OTHER PUBLICATIONS

International Preliminary Report on Patentability (PCT/IB/338 & PCT/IB/373) issued in PCT Application No. PCT/JP2017/032162 dated Apr. 11, 2019, including English translation of document C2 (Japanese-language Written Opinion (PCT/ISA/237) previously filed on Sep. 13, 2018 (five pages).

(Continued)

*Primary Examiner* — Ramsey Refai
(74) *Attorney, Agent, or Firm* — Crowell & Moring LLP

(57) ABSTRACT

A construction machine capable of achieving favorable operability in a combined operation is provided. A hybrid excavator includes: a boom cylinder 10 driven by hydraulic fluid from a hydraulic pump 16*b*; a swing hydraulic motor 5 driven by hydraulic fluid from the hydraulic pump 16*b*; a swing electric motor 6 connected mechanically with the swing hydraulic motor 5; an inverter 19 that controls operation of the swing electric motor 6; and a controller 21 that outputs to the inverter 19 a torque command value for controlling electric driving torque or electricity generating torque of the swing electric motor 6. The controller 21

(Continued)

includes a torque command value calculation section 24 that receives inputs of a swing operation amount signal of an operation lever device 15*a* and a boom raising operation amount signal of an operation lever device 15*b* and that outputs a torque command value of the electricity generating torque of the swing electric motor 6 to the inverter 19 when load pressure of the swing hydraulic motor 5 is determined to be higher than load pressure of the boom cylinder 10.

13 Claims, 12 Drawing Sheets

(52) U.S. Cl.
CPC ..... *E02F 9/2037* (2013.01); *E02F 9/2041* (2013.01); *E02F 9/22* (2013.01); *E02F 9/2228* (2013.01); *E02F 9/2285* (2013.01)

(56) References Cited

U.S. PATENT DOCUMENTS

| | | | | |
|---|---|---|---|---|
| 2013/0180247 | A1* | 7/2013 | Yamada | F04B 17/03 60/706 |
| 2013/0311054 | A1 | 11/2013 | Choi | |
| 2014/0199148 | A1 | 7/2014 | Imura et al. | |
| 2016/0002887 | A1* | 1/2016 | Izumi | E02F 9/2235 701/50 |
| 2016/0003266 | A1 | 1/2016 | Imura et al. | |
| 2016/0257293 | A1 | 9/2016 | Takahashi et al. | |
| 2016/0348340 | A1 | 12/2016 | Kaneta et al. | |

FOREIGN PATENT DOCUMENTS

| | | | |
|---|---|---|---|
| JP | 59-126829 | A | 7/1984 |
| JP | 2008-115640 | A | 5/2008 |
| JP | 2012-162861 | A | 8/2012 |
| JP | 2013-2119 | A | 1/2013 |
| JP | 2014-505807 | A | 3/2014 |
| JP | 2015-48626 | A | 3/2015 |
| JP | 2015-155615 | A | 8/2015 |
| JP | 2016-160667 | A | 9/2016 |

OTHER PUBLICATIONS

Extended European Search Report issued in European Application No. 17855646.0 dated Apr. 24, 2020 (seven pages).

International Search Report (PCT/ISA/210) issued in PCT Application No. PCT/JP2017/032162 dated Dec. 5, 2017 with English translation (six (6) pages).

Japanese-language Written Opinion (PCT/ISA/237) issued in PCT Application No. PCT/JP2017/032162 dated May 12, 2017 (three (3) pages).

Korean-language Office Action issued in counterpart Korean Application No. 10-2018-7025985 dated Sep. 27, 2019 (four pages).

* cited by examiner

CONSTRUCTION MACHINE

TECHNICAL FIELD

The present invention relates generally to construction machines such as excavators and, more particularly, to a construction machine that includes a swing hydraulic motor and a boom cylinder driven independently by respective hydraulic pumps and that uses both the swing hydraulic motor and a swing electric motor as swing actuators.

BACKGROUND ART

A known hydraulic excavator includes a swing hydraulic motor and a boom cylinder driven by an identical hydraulic pump and uses the swing hydraulic motor only as a swing actuator (in other words, the hydraulic excavator does not include any swing electric motor). In this hydraulic excavator, a swing direction control valve and a boom direction control valve are connected in parallel with an identical pump line. During a combined operation involving swing and boom raising, hydraulic fluid flows from the hydraulic pump to either the swing hydraulic motor or the boom cylinder, whichever has lower load pressure. In addition, the hydraulic fluid, which has pressure identical to the pressure of the hydraulic fluid flowing to the swing hydraulic motor or the boom cylinder having lower load pressure, flows from the hydraulic pump also to the swing hydraulic motor or the boom cylinder, whichever has higher load pressure. The load pressure of the swing hydraulic motor (swing load pressure) thereby balances with the load pressure of the boom cylinder (boom load pressure). Favorable operability in combined operations is thereby achieved.

To elaborate on the foregoing explanation, when the boom load pressure is low (specifically, when, for example, a bucket is in an empty state or an operation amount of a boom operation device is small), the swing load pressure is reduced to match the boom load pressure, resulting in a lower swing speed. When the boom load pressure is high (specifically, when, for example, the bucket is loaded or the operation amount of the boom operation device is large), the swing load pressure is increased to match the boom load pressure, resulting in a swing speed higher than when the boom load pressure is low. The swing load pressure is automatically adjusted, and the swing speed is automatically adjusted, to correspond to the boom load pressure as described above and favorable operability in combined operations is thereby achieved.

Another known hydraulic excavator is a hybrid excavator that includes a swing hydraulic motor and a boom cylinder driven independently by respective hydraulic pumps and that uses both the swing hydraulic motor and a swing electric motor as swing actuators (see, for example, the second embodiment of Patent Document 1). The swing electric motor functions as both an electric motor that assists the swing hydraulic motor and a generator. In Patent Document 1, when the swing electric motor is driven as the electric motor, torque of the swing hydraulic motor is reduced for an increase in torque of the swing electric motor.

Still another known hydraulic excavator is a hybrid excavator that includes a swing hydraulic motor and a boom cylinder driven by an identical hydraulic pump and that uses both the swing hydraulic motor and a swing electric motor as swing actuators (see, for example, Patent Document 2). In Patent Document 2, when the boom load is received (when the bucket is loaded) during a combined operation involving swing and boom raising, the swing speed is reduced with a decreasing boom speed and the swing electric motor is driven as the generator. Specifically, an absolute value of electricity generating torque (negative torque) of the swing electric motor is increased with an increasing boom load, to thereby reduce total torque of the swing hydraulic motor and the swing electric motor.

PRIOR ART DOCUMENT

Patent Document

Patent Document 1: JP-2012-162861-A (see FIG. 10)
Patent Document 2: JP-2015-155615-A

SUMMARY OF THE INVENTION

Problem to be Solved by the Invention

The hybrid excavator according to the second embodiment of Patent Document 1 (specifically, the construction machine that includes the swing hydraulic motor and the boom cylinder driven independently by the respective hydraulic pumps and that uses both the swing hydraulic motor and the swing electric motor as the swing actuators) has the following improvements to be made.

In the hybrid excavator according to the second embodiment of Patent Document 1, the swing hydraulic motor and the boom cylinder are driven independently by the respective hydraulic pumps. Thus, unlike the configuration in which the swing hydraulic motor and the boom cylinder are driven by the identical pump, flow division loss does not occur and energy saving can be promoted. The swing speed does not, however, change even when the swing independent operation is shifted to the combined operation involving swing and boom raising. The swing speed does not change, either, even with fluctuating load pressure of the boom cylinder during the combined operation involving swing and boom raising.

An operator who is accustomed to operation of the conventional hydraulic excavator described above (specifically, the construction machine that includes the swing hydraulic motor and the boom cylinder driven by the identical hydraulic pump and that uses the swing hydraulic motor only as the swing actuator) expects that the swing speed decreases when the swing independent operation is shifted to the combined operation involving swing and boom raising. The operator also expects that the swing speed changes automatically as the boom load varies at a time of the combined operation involving swing and boom raising. Thus, the operator may feel uneasy with the operability in combined operations of the hybrid excavator.

Additionally, the combined operation involving swing and boom raising performed by the conventional hydraulic excavator has a characteristic that the swing torque (torque of the swing hydraulic motor) increases with an increasing boom load as shown in FIG. 13. In contrast, the combined operation involving swing and boom raising performed by the hybrid excavator disclosed in Patent Document 2 has a characteristic that the swing torque (total torque of the swing hydraulic motor and the swing electric motor) decreases with an increasing boom load as shown in FIG. 14. Thus, mere implementation of the technique disclosed in Patent Document 2 in the hybrid excavator in the second embodiment of Patent Document 1 does not unfortunately achieve the operability in the combined operation involving swing and boom raising in the conventional hydraulic excavator.

An object of the present invention is to achieve, in a construction machine that includes a swing hydraulic motor and a boom cylinder driven independently by respective hydraulic pumps and that uses both the swing hydraulic motor and a swing electric motor as swing actuators, operability in a combined operation involving swing and boom raising comparable to operability achieved by a construction machine that includes a swing hydraulic motor and a boom cylinder driven by an identical hydraulic pump and that uses the swing hydraulic motor only as a swing actuator.

Means for Solving the Problem

To achieve the foregoing object, an aspect of the present invention provides a construction machine including: a track structure; a swing structure disposed swingably on the track structure; a work implement including a boom, an arm, and a bucket, the boom being coupled vertically swingably to the swing structure; a first hydraulic pump and a second hydraulic pump that are driven by a prime mover; a boom cylinder driven by hydraulic fluid from the second hydraulic pump to thereby drive the boom; a swing hydraulic motor driven by hydraulic fluid from the first hydraulic pump to thereby drive the swing structure; a swing electric motor connected mechanically with the swing hydraulic motor; an inverter that controls operation of the swing electric motor; a controller that calculates a torque command value for controlling electric driving torque and electricity generating torque of the swing electric motor and outputs the torque command value to the inverter; a first operation lever device that directs operation of the swing structure; and a second operation lever device that directs operation of the boom. The controller includes a torque command value calculation section that receives inputs of a swing operation amount signal of the first operation lever device and a boom raising operation amount signal of the second operation lever device and that outputs a torque command value of the electricity generating torque of the swing electric motor to the inverter when load pressure of the swing hydraulic motor is determined to be higher than load pressure of the boom cylinder.

Effect of the Invention

The aspect of the present invention can achieve, in a construction machine that includes the swing hydraulic motor and the boom cylinder driven independently by the respective hydraulic pumps and that uses both the swing hydraulic motor and the swing electric motor as swing actuators, operability in a combined operation involving swing and boom raising comparable to the operability achieved by the construction machine that includes the swing hydraulic motor and the boom cylinder driven by the identical hydraulic pump and that uses the swing hydraulic motor only as the swing actuator.

MODES FOR CARRYING OUT THE INVENTION

A first embodiment of the present invention will be described below with reference to the accompanying drawings.

Figure 1:
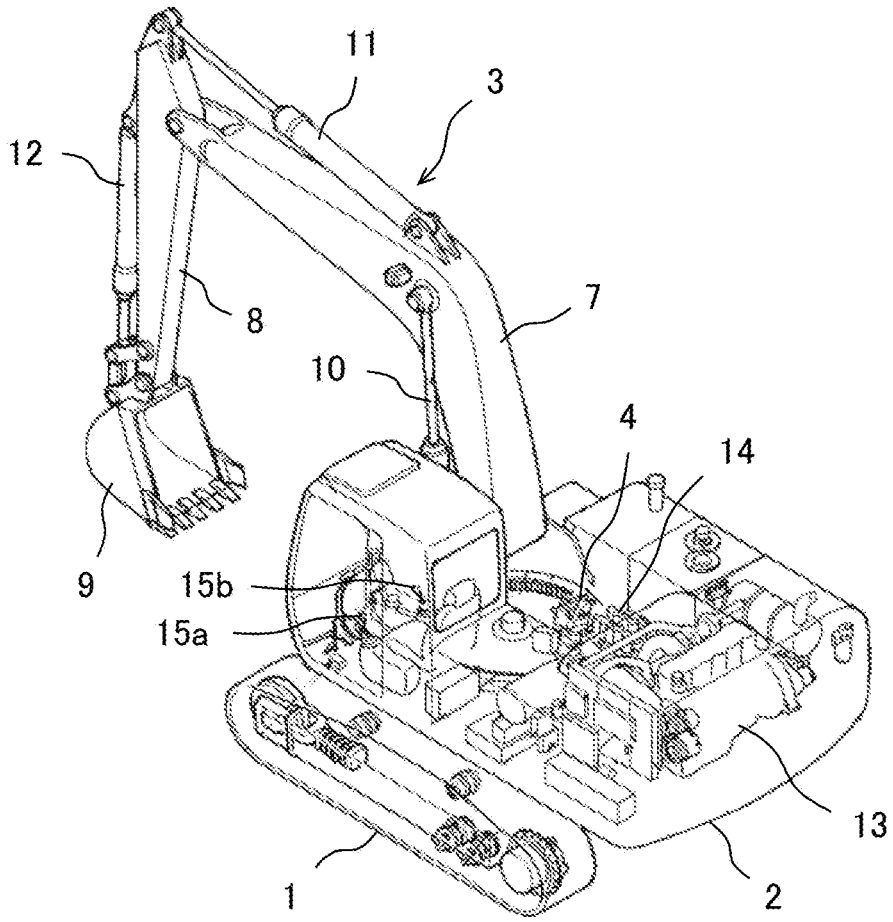
FIG. 1 is a perspective view of a structure of a hybrid excavator according to a first embodiment of the present invention.

FIG. 1 is a perspective view of a structure of a hybrid excavator in the present embodiment.

The hybrid excavator in the present embodiment includes a track structure 1, a swing structure 2, and a work implement 3. The swing structure 2 is swingably disposed on the track structure 1. The work implement 3 is coupled to a front portion of the swing structure 2. The track structure 1 is driven by a track hydraulic motor not shown to travel.

Figure 2:
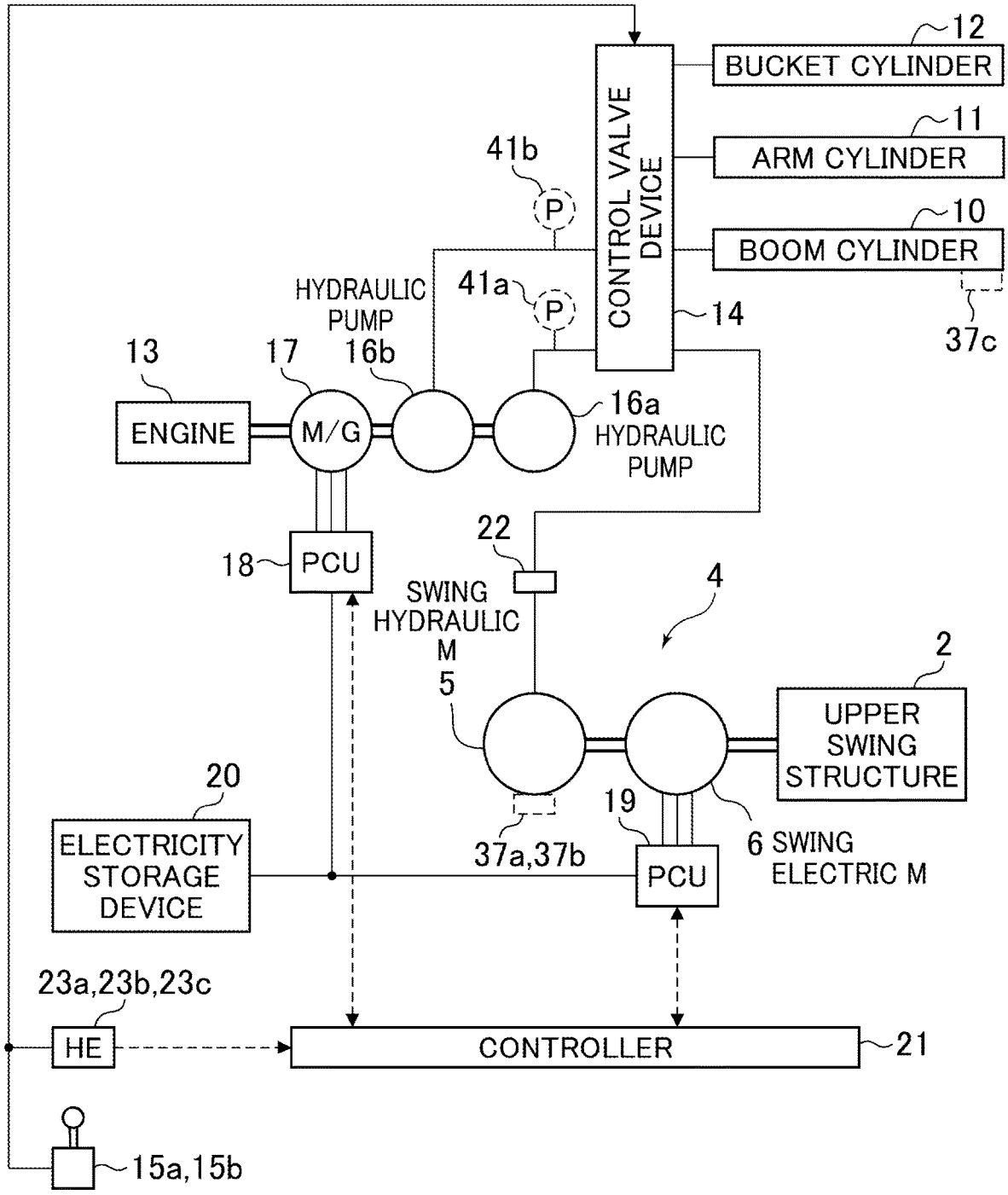
FIG. 2 is a schematic diagram of a configuration of an actuator drive control system of the hybrid excavator according to the first embodiment of the present invention.

The swing structure 2 is swung by a swing device 4. The swing device 4 includes, as shown in FIG. 2 to which reference will later be made, a swing hydraulic motor 5 and a swing electric motor 6. The swing hydraulic motor 5 drives the swing structure 2. The swing electric motor 6 is mechanically coupled with the swing hydraulic motor 5.

The work implement 3 includes a boom 7, an arm 8, and a bucket 9. The boom 7 is vertically rotatably coupled with a front portion of the swing structure 2. The arm 8 is vertically rotatably coupled with the boom 7. The bucket 9 is vertically rotatably coupled with the arm 8. The boom 7, the arm 8, and the bucket 9 are rotated as driven by a boom cylinder 10, an arm cylinder 11, and a bucket cylinder 12, respectively.

An engine 13 (prime mover), a control valve device 14, and the like are mounted on the swing structure 2. An operation lever device 15*a* and an operation lever device 15*b*, for example, are disposed in a cab of the swing structure 2. The operation lever device 15*a* is disposed on the left of a driver's seat. The operation lever device 15*b* is disposed on the right of the driver's seat.

FIG. 2 is a schematic diagram of a configuration of an actuator drive control system of the hybrid excavator in the present embodiment. The following, while describing configurations relating to driving of the swing structure 2, the boom 7, the arm 8, and the bucket 9, omits describing configurations relating to driving of the track structure 1.

The actuator drive control system in the present embodiment includes the engine 13, hydraulic pumps 16*a* and 16*b*, the operation lever devices 15*a* and 15*b*, the control valve device 14, the swing hydraulic motor 5, the boom cylinder 10, the arm cylinder 11, and the bucket cylinder 12. The actuator drive control system further includes an electric motor generator (M/G) 17, an inverter (PCU) 18 for the electric motor generator 17, the swing electric motor 6, an inverter (PCU) 19 for the swing electric motor 6, an electricity storage device 20, and a controller 21. The actuator drive control system further includes, though not shown, an engine control unit for controlling the engine 13 and a battery control unit for controlling the electricity storage device 20.

The hydraulic pumps 16*a* and 16*b* are driven by the engine 13 alone, or by the engine 13 and the electric motor generator 17. The hydraulic pumps 16*a* and 16*b* are each a variable displacement type including a regulator (not shown).

The regulator increases a tilting angle of a swash plate (capacity) of the corresponding hydraulic pump with an increasing operation amount (demanded flow rate) of the operation lever device 15*a* or 15*b*. The regulator also decreases the tilting angle of the swash plate (capacity) of the corresponding hydraulic pump with increasing delivery pressure of the corresponding hydraulic pump. The torque of the hydraulic pump is thereby controlled so as not to exceed a predetermined maximum value (torque limiting control function).

The operation lever device 15*a* includes, though not shown, an operation lever and four pilot valves. The operation lever can be operated in a front-rear direction and a left-right direction. A first one of the pilot valves generates and outputs a clockwise swing operation amount signal (hydraulic signal) according to an operation amount of the operation lever toward the front. A second one of the pilot valves generates and outputs a counterclockwise swing operation amount signal (hydraulic signal) according to an operation amount of the operation lever toward the rear. A third one of the pilot valves generates and outputs an arm dumping operation amount signal (hydraulic signal) according to an operation amount of the operation lever toward the left. A fourth one of the pilot valves generates and outputs an arm crowding operation amount signal (hydraulic signal) according to an operation amount of the operation lever toward the right.

The operation lever device 15*b* includes, though not shown, an operation lever and four pilot valves. The operation lever can be operated in a front-rear direction and a left-right direction. A first one of the pilot valves generates and outputs a boom lowering operation amount signal (hydraulic signal) according to an operation amount of the operation lever toward the front. A second one of the pilot valves generates and outputs a boom raising operation amount signal (hydraulic signal) according to an operation amount of the operation lever toward the rear. A third one of the pilot valves generates and outputs a bucket crowding operation amount signal (hydraulic signal) according to an operation amount of the operation lever toward the left. A fourth one of the pilot valves generates and outputs a bucket dumping operation amount signal (hydraulic signal) according to an operation amount of the operation lever toward the right.

The control valve device 14 includes, though not shown, a swing direction control valve, a boom direction control valve, an arm direction control valve, and a bucket direction control valve.

The swing direction control valve is operated by the clockwise swing operation amount signal or the counterclockwise swing operation amount signal from the operation lever device 15*a* to thereby vary a flow (direction and flow rate) of hydraulic fluid from the hydraulic pump 16*a* to the swing hydraulic motor 5. The swing hydraulic motor 5 is thereby driven. A relief valve 22 is disposed in a line between the hydraulic pump 16*a* and the swing hydraulic motor 5 (in the present embodiment, a line between the swing direction control valve and the swing hydraulic motor 5).

The boom direction control valve is operated by the boom raising operation amount signal or the boom lowering operation amount signal from the operation lever device 15*b* to thereby vary a flow (direction and flow rate) of the hydraulic fluid from the hydraulic pump 16*b* to the boom cylinder 10. The boom cylinder 10 is thereby driven.

The arm direction control valve is operated by the arm dumping operation amount signal or the arm crowding operation amount signal from the operation lever device 15*a* to thereby vary a flow (direction and flow rate) of the hydraulic fluid from the hydraulic pump 16*b* to the arm cylinder 11. The arm cylinder 11 is thereby driven.

The bucket direction control valve is operated by the bucket crowding operation amount signal or the bucket dumping operation amount signal from the operation lever device 15*b* to thereby vary a flow (direction and flow rate) of the hydraulic fluid from the hydraulic pump 16*b* to the bucket cylinder 12. The bucket cylinder 12 is thereby driven.

The hydraulic pump that supplies the arm cylinder 11 and the bucket cylinder 12 with the hydraulic fluid may be changed to the hydraulic pump 16*a*. Alternatively, a new hydraulic pump may be added for the purpose.

Pilot pressure sensors 23*a* and 23*b* (first operation sensors) are disposed in a hydraulic line between the operation lever device 15*a* and the swing direction control valve. A pilot pressure sensor 23*c* (second operation sensor) is disposed in a hydraulic line between the operation lever device 15*b* and the boom direction control valve.

The pilot pressure sensor 23*a* detects the clockwise swing operation amount signal (hydraulic signal) of the operation lever device 15*a* and converts the clockwise swing operation amount signal to a corresponding electric signal before outputting the electric signal to the controller 21. The pilot pressure sensor 23*b* detects the counterclockwise swing operation amount signal (hydraulic signal) of the operation lever device 15*a* and converts the counterclockwise swing operation amount signal to a corresponding electric signal before outputting the electric signal to the controller 21. The pilot pressure sensor 23*c* detects the boom raising operation amount signal (hydraulic signal) of the operation lever device 15*b* and converts the boom raising operation amount signal to a corresponding electric signal before outputting the electric signal to the controller 21.

The electric motor generator 17 is disposed between the engine 13 and the hydraulic pumps 16*a* and 16*b*. The electric motor generator 17 functions as an electric motor that assists the engine 13 in driving the hydraulic pumps 16*a* and 16*b* and as a generator that is driven by the engine 13 to generate electricity.

The inverter 18 controls the electric motor generator 17 in response to a command from the controller 21. Specifically, to control the electric motor generator 17 as the electric motor, the inverter 18 converts DC power from the electricity storage device 20 to AC power and supplies the AC power to the electric motor generator 17. To control the electric motor generator 17 as the generator, the inverter 18 converts AC power generated by the electric motor generator 17 to DC power and supplies the DC power to the electricity storage device 20.

The swing electric motor 6 functions as an electric motor that assists the swing hydraulic motor 5 in driving the swing structure 2 and as a generator that generates electricity during, for example, deceleration or braking of the swing structure 2. Specifically, a total value of torque of the swing hydraulic motor 5 and electric driving torque (positive torque) or electricity generating torque (negative torque) of the swing electric motor 6 assumes swing torque acting on the swing structure 2.

The inverter 19 controls the swing electric motor 6 as the electric motor when a torque command value (positive torque command value) for controlling the electric driving torque of the swing electric motor 6 is applied from the controller 21. Specifically, the inverter 19 converts DC power from the electricity storage device 20 or the inverter 18 to AC power and supplies the AC power to the swing electric motor 6. When a torque command value (negative torque command value) for controlling the electricity generating torque of the swing electric motor 6 is applied from the controller 21, the inverter 19 controls the electric motor generator 17 as the generator. Specifically, the inverter 19 converts AC power generated by the swing electric motor 6 to DC power and supplies the DC power to the electricity storage device 20 or the inverter 18.

The electricity storage device 20 is, for example, a lithium ion battery or a capacitor. The electricity storage device 20 stores electricity to be exchanged between the inverters 18 and 19.

The controller 21 integrally controls the inverters 18 and 19, an engine control unit, and a battery control unit. The controller 21 includes, for example, an calculation control part (e.g., CPU) that performs calculation processing and control processing using a program and a storage part (e.g., ROM and RAM) that stores the program and results of the calculation processing.

Figure 3:
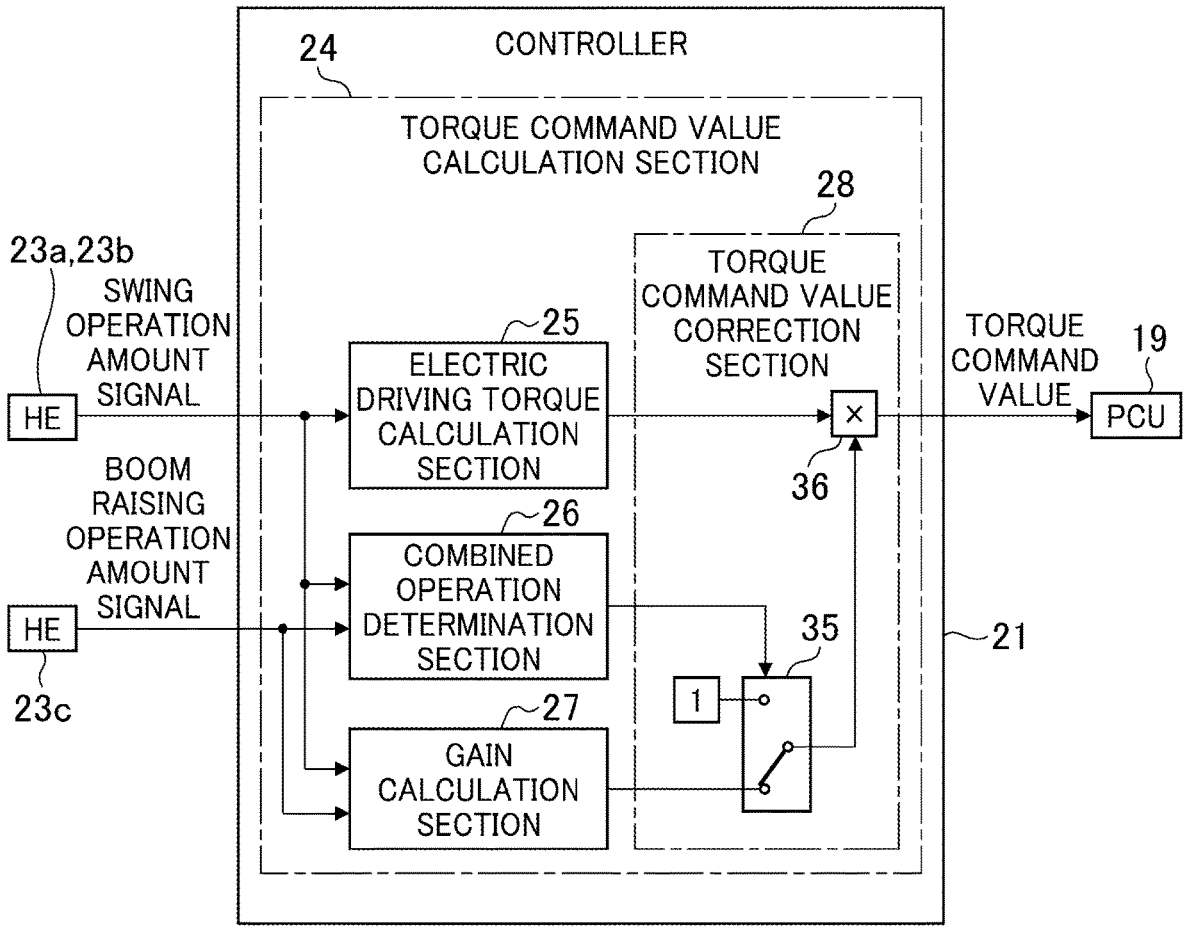
FIG. 3 is a block diagram of a processing function of a controller in the first embodiment of the present invention.
Figure 4:
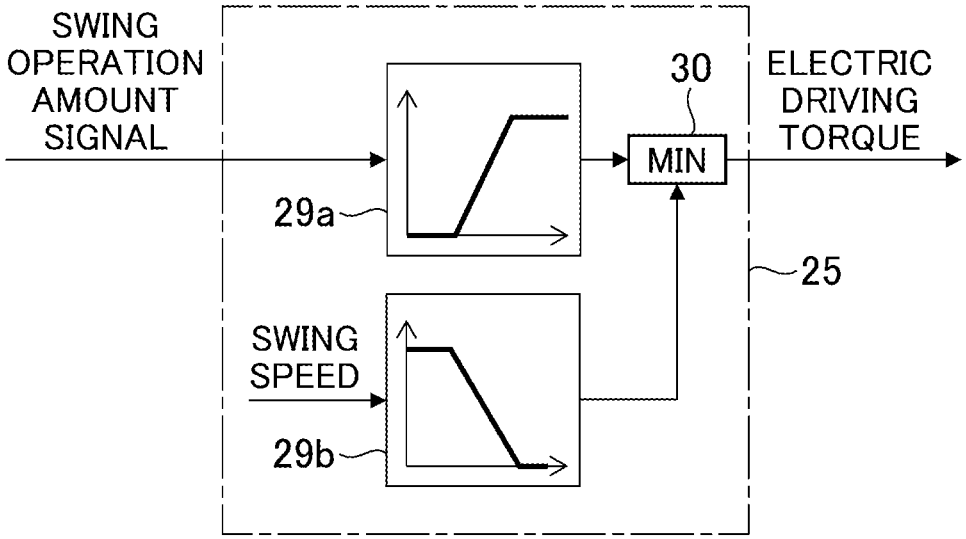
FIG. 4 is a detailed block diagram of an electric driving torque calculation section of the controller in the first embodiment of the present invention.
Figure 5:
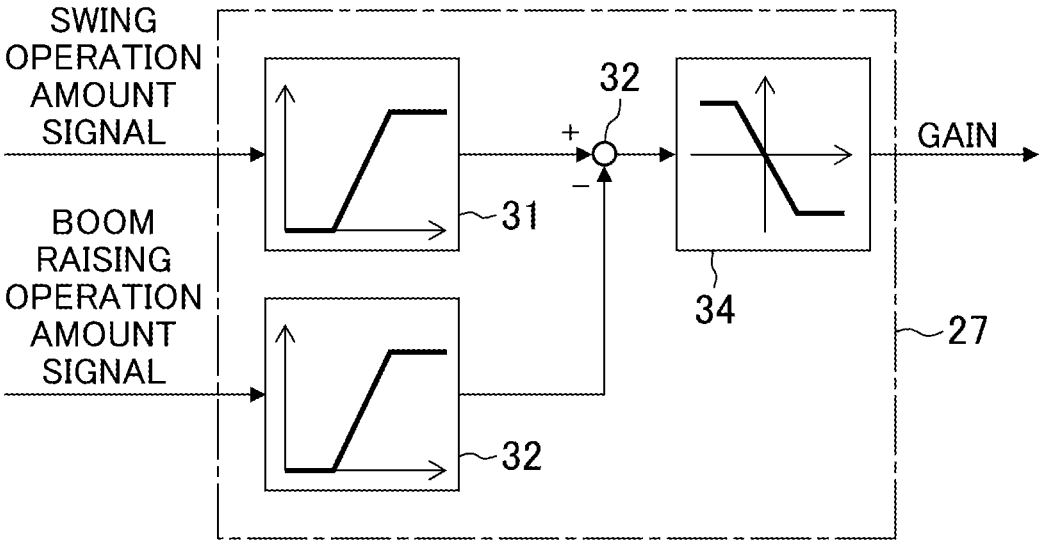
FIG. 5 is a detailed block diagram of a gain calculation section of the controller in the first embodiment of the present invention.

One of the most noteworthy features of the present embodiment is a processing function of the controller 21 relating to the control of the inverter 19 (specifically, torque control of the swing electric motor 6). Details of the processing function will be described with reference to FIGS. 3 to 5. FIG. 3 is a block diagram of the processing function of the controller in the present embodiment. FIG. 4 is a detailed block diagram of an electric driving torque calculation section of the controller in the present embodiment. FIG. 5 is a detailed block diagram of a gain calculation section of the controller in present embodiment.

The controller 21 includes a torque command value calculation section 24, with which the controller 21 calculates a torque command value for controlling the electric driving torque or the electricity generating torque of the swing electric motor 6 and outputs the torque command value to the inverter 19. The torque command value is calculated on the basis of a swing operation amount signal of the operation lever device 15*a* applied from the pilot pressure sensor 23*a* or 23*b*, a boom raising operation amount signal of the operation lever device 15*b* applied from the pilot pressure sensor 23*c*, and a swing speed signal (rotational speed signal of the swing electric motor 6) applied from the inverter 19.

The torque command value calculation section 24 includes an electric driving torque calculation section 25, a combined operation determination section 26, a gain calculation section 27, and a torque command value correction section 28. The electric driving torque calculation section 25 calculates the electric driving torque of the swing electric motor 6 (which corresponds to the torque command value during a swing independent operation; to be detailed later) on the basis of the swing operation amount signal and the swing speed signal. The combined operation determination section 26 determines whether a combined operation involving swing and boom raising is being performed using the swing operation amount signal and the boom raising operation amount signal. The gain calculation section 27 calculates gain on the basis of the swing operation amount signal and the boom raising operation amount signal.

The electric driving torque calculation section 25 includes electric driving torque calculation tables 29*a* and 29*b* and a minimum value selection section 30.

The electric driving torque calculation table 29*a* represents a relation established in advance between the swing operation amount and the electric driving torque. Specifically, as shown in FIG. 4, the relation is set such that the electric driving torque on the ordinate remains zero when the swing operation amount on the abscissa is smaller than a predetermined value and that the electric driving torque increases with an increasing swing operation amount from the predetermined value. The electric driving torque calculation table 29*b* represents a relation established in advance between the swing speed and the electric driving torque. Specifically, as shown in FIG. 4, the relation is set such that the electric driving torque on the ordinate remains zero when the swing speed on the abscissa is greater than a predetermined value and that the electric driving torque increases with an decreasing swing speed from the predetermined value.

The electric driving torque calculation section 25 uses the electric driving torque calculation table 29*a* to calculate an electric driving torque value from the swing operation amount signal. The electric driving torque calculation section 25 uses the electric driving torque calculation table 29*b* to calculate an electric driving torque value from the swing speed signal. The minimum value selection section 30 selects either the electric driving torque value calculated using the electric driving torque calculation table 29*a* or the electric driving torque value calculated using the electric driving torque calculation table 29*b*, whichever is smaller, and the selected value is output to the torque command value correction section 28.

The combined operation determination section 26 determines whether the swing operation amount is equal to or greater than a threshold and whether the boom raising operation amount is equal to or greater than a threshold, to thereby determine whether a combined operation involving swing and boom raising is being performed. The combined operation determination section 26 then outputs a result of the determination made to the torque command value correction section 28.

The gain calculation section 27 includes a swing load pressure calculation table 31, a boom load pressure calculation table 32, a subtraction section 33, and a gain calculation table 34.

The swing load pressure calculation table 31 represents a relation established in advance between the swing operation amount and an estimated value of load pressure of the swing hydraulic motor 5 (swing load pressure). Specifically, as shown in FIG. 5, the relation is set such that the swing load pressure estimated value on the ordinate remains zero when the swing operation amount on the abscissa is smaller than a predetermined value and that the swing load pressure estimated value increases with an increasing swing operation amount from the predetermined value.

The boom load pressure calculation table 32 represents a relation established in advance between the boom raising operation amount and an estimated value of load pressure of the boom cylinder 10 (boom load pressure). Specifically, as shown in FIG. 5, the relation is set such that the boom load pressure estimated value on the ordinate remains zero when the boom raising operation amount on the abscissa is smaller than a predetermined value and that the boom load pressure estimated value increases with an increasing boom raising operation amount from the predetermined value.

The gain calculation section 27 uses the swing load pressure calculation table 31 to calculate the swing load pressure estimated value from the swing operation amount signal. The gain calculation section 27 uses the boom load pressure calculation table 32 to calculate the boom load pressure estimated value from the boom raising operation amount signal. The gain calculation section 27 then causes the subtraction section 33 to calculate differential pressure between the swing load pressure estimated value and the boom load pressure estimated value.

The gain calculation table 34 represents a relation established in advance between the differential pressure and gain. Specifically, as shown in FIG. 5, the relation is set such that the gain on the ordinate is a positive value when the differential pressure on the abscissa is smaller than zero and the gain increases with decreasing differential pressure from zero, and such that the gain is a negative value when the differential pressure is greater than zero and the gain decreases (in other words, an absolute value of the negative gain increases) with increasing differential pressure from zero. It is noted that the gain may have a maximum value of "1"; however, the maximum value is set to less than "1" in the present embodiment.

The gain calculation section 27 uses the gain calculation table 34 to calculate gain from the differential pressure calculated by the subtraction section 33 and outputs the gain to the torque command value correction section 28.

The torque command value correction section 28 includes a gain changeover section 35 and a multiplication section 36. When the combined operation determination section 26 determines that the combined operation involving swing and boom raising is not being performed, the gain changeover section 35 selects gain "1" and outputs the gain "1" to the multiplication section 36. The multiplication section 36 multiplies the electric driving torque value calculated by the electric driving torque calculation section 25 by the gain "1" to thereby find a torque command value and outputs the torque command value to the inverter 19. To state the foregoing differently, the electric driving torque value calculated by the electric driving torque calculation section 25 is set as a positive torque command value and output to the inverter 19. The swing electric motor 6 is thereby caused to perform electrical driving (powering) and the electric driving torque (positive torque) thereof is controlled.

When the combined operation determination section 26 determines that the combined operation involving swing and boom raising is being performed, the gain changeover section 35 selects the gain calculated by the gain calculation section 27 and outputs the gain to the multiplication section 36. The multiplication section 36 multiplies the electric driving torque value calculated by the electric driving torque calculation section 25 by the gain calculated by the gain calculation section 27 to thereby find a torque command value. The multiplication section 36 then outputs the torque command value to the inverter 19. To state the foregoing differently, a value obtained by multiplying the electric driving torque value calculated by the electric driving torque calculation section 25 by the gain calculated by the gain calculation section 27 is set as the torque command value and the torque command value is output to the inverter 19.

As described previously, when the differential pressure between the swing load pressure estimated value and the boom load pressure estimated value is smaller than zero (in other words, when the swing load pressure estimated value is smaller than the boom load pressure estimated value), the gain is a positive value and the positive torque command value is set and output. The swing electric motor 6 is thereby caused to perform electrical driving (powering) and the electric driving torque (positive torque) thereof is controlled.

When the differential pressure between the swing load pressure estimated value and the boom load pressure estimated value is greater than zero (in other words, when the swing load pressure estimated value is greater than the boom load pressure estimated value), the gain is a negative value and the negative torque command value is set and output. The swing electric motor 6 is thereby caused to generate electricity (perform regeneration) and the electricity generating torque (negative torque) thereof is controlled.

Figure 6:
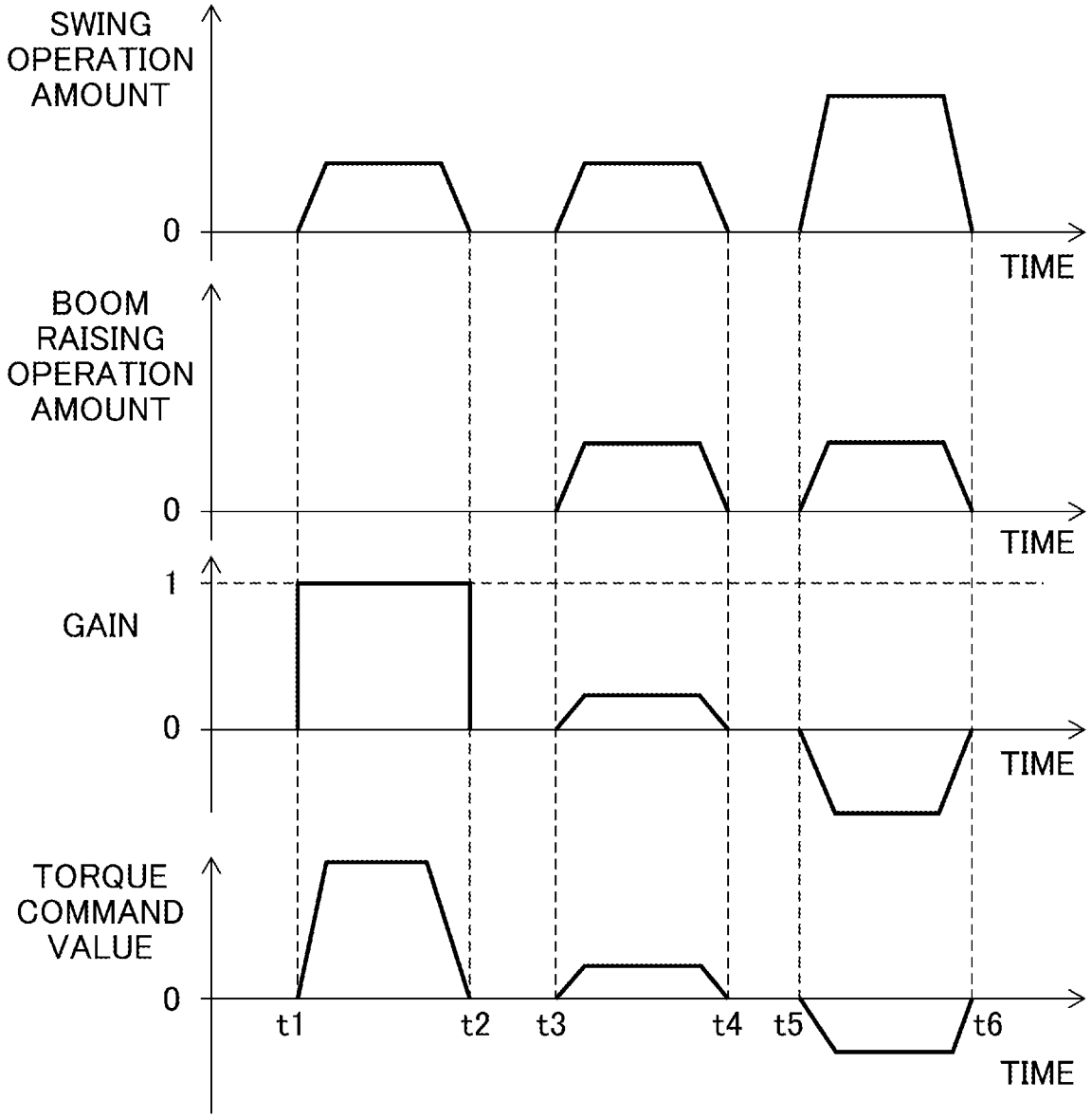
FIG. 6 is a timing chart for illustrating operations in the first embodiment of the present invention.

Operations and effects of the present embodiment will be described below. FIG. 6 is a timing chart for illustrating operations in the present embodiment.

A swing independent operation is performed for a period of time from time t1 to time t2. Thus, the torque command value calculation section 24 of the controller 21 selects the gain "1." Then, the electric driving torque value calculated by the electric driving torque calculation section 25 is multiplied by the gain "1" to thereby find a positive torque command value and outputs the positive torque command value to the inverter 19. The swing electric motor 6 is thereby caused to perform electrical driving.

For a period of time from time t3 to time t4, a combined operation involving swing and boom raising is being performed. Thus, the torque command value calculation section 24 of the controller 21 selects the gain calculated by the gain calculation section 27. When, at this time, the swing operation amount is relatively small as shown in FIG. 6, the swing load pressure estimated value is relatively small and is smaller than the boom load pressure estimated value. As a result, the gain calculated by the gain calculation section 27 is a positive value. The electric driving torque value calculated by the electric driving torque calculation section 25 is then multiplied by positive gain to thereby find a positive torque command value and the positive torque command value is output to the inverter 19. The swing electric motor 6 is thereby caused to perform electrical driving.

For a period of time from time t5 to time t6, a combined operation involving swing and boom raising is being performed. Thus, the torque command value calculation section 24 of the controller 21 selects the gain calculated by the gain calculation section 27. When, at this time, the swing operation amount is relatively large as shown in FIG. 6, the swing load pressure estimated value is relatively great and is greater than the boom load pressure estimated value. As a result, the gain calculated by the gain calculation section 27 is a negative value. The electric driving torque value calculated by the electric driving torque calculation section 25 is then multiplied by negative gain to thereby find a negative torque command value and the negative torque command value is output to the inverter 19. The swing electric motor 6 is thereby caused to generate electricity. The swing torque (total torque of the swing hydraulic motor 5 and the swing electric motor 6) is thus reduced.

During the combined operation involving swing and boom raising, the boom load pressure increases with an increasing boom raising operation amount. The conventional hydraulic excavator, which uses the identical hydraulic pump to drive both the swing hydraulic motor and the boom cylinder, uses the boom load pressure to drive the swing hydraulic motor. The rotational speed of the swing hydraulic motor (swing speed) is thus adjusted to correspond to the boom raising operation amount, so that favorable operability in the combined operation involving swing and boom raising can be obtained.

In contrast, in the hydraulic excavator that uses separate hydraulic pumps to drive the swing hydraulic motor and the boom cylinder, drive pressure occurs separately in the swing hydraulic motor and the boom cylinder. This disables adjustment of the rotational speed of the swing hydraulic motor to correspond to the boom load pressure and favorable operability in the combined operation involving swing and boom raising is difficult to achieve.

Figure 13:
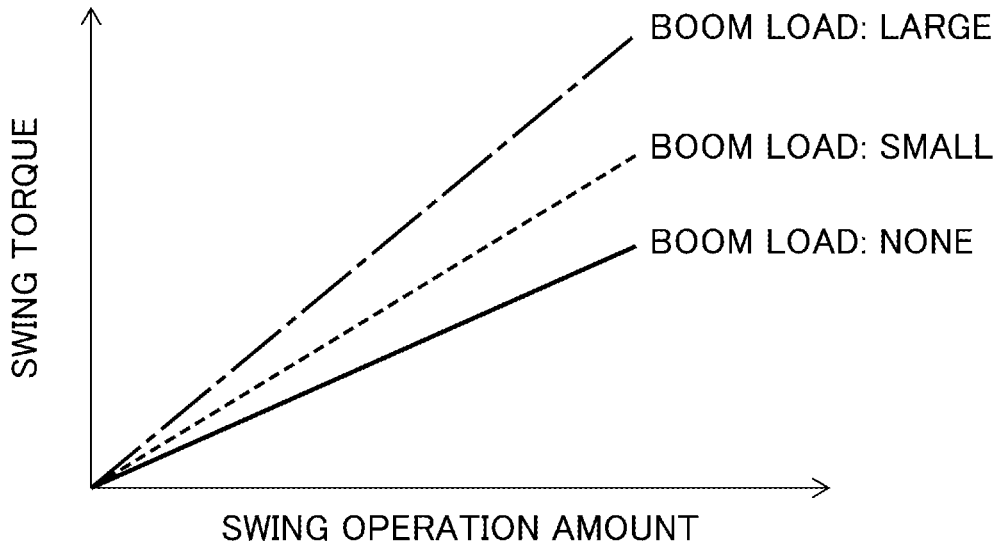
FIG. 13 is a characteristic diagram for illustrating operability in a combined operation involving swing and boom raising in a conventional hydraulic excavator.
Figure 14:
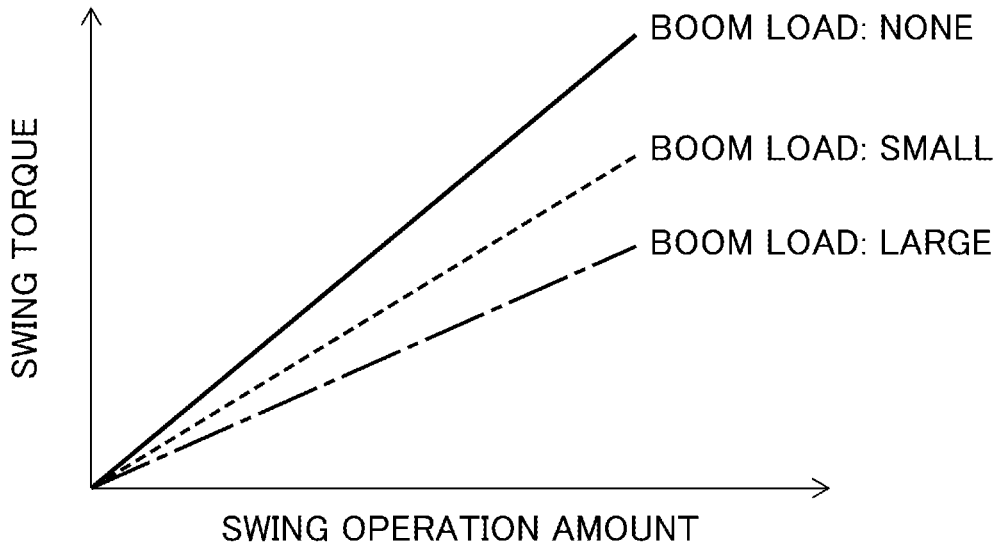
FIG. 14 is a characteristic diagram for illustrating operability in a combined operation involving swing and boom raising in a hybrid excavator disclosed in Patent Document 2.

In the present embodiment, when the swing load pressure estimated value is greater than the boom load pressure estimated value (when the swing load pressure is determined to be greater than the boom load pressure) during the combined operation involving swing and boom raising, the swing electric motor 6 is caused to generate electricity to thereby reduce the swing torque (total torque of the swing hydraulic motor 5 and the swing electric motor 6) and to reduce the swing speed. This allows the swing hydraulic motor 5 to be rotated at a speed equivalent to a speed when driven with the boom load pressure. Thus, operability in the combined operation involving swing and boom raising similar to the operability achieved by the conventional hydraulic excavator (specifically, the hydraulic excavator that includes the swing hydraulic motor and the boom cylinder driven by the identical hydraulic pump and uses the swing hydraulic motor only as the swing actuator) can be achieved. Specifically, the operability in the combined operation having the characteristic shown in FIG. 13 can be achieved.

In the present embodiment, the maximum gain value is set to less than "1." This arrangement reliably allows the torque of the swing electric motor during the combined operation involving swing and boom raising to be smaller than the torque of the swing electric motor during the swing independent operation. Thus, the swing speed during the combined operation involving swing and boom raising can be made slower than the swing speed during the swing independent operation.

The controller 21 calculates the torque command value of the swing electric motor on the basis of the swing operation amount signal of the operation lever device 15*a* and the boom raising operation amount signal of the operation lever device 15*b* and outputs it (feed forward control). Thus, compared with a type of control in which the swing load pressure and the boom load pressure are detected, and on the basis of a detection value of the swing load pressure and a detection value of the boom load pressure, the torque command value of the swing electric motor is calculated and output (feedback control), the swing speed can be reduced immediately upon the start of the combined operation involving swing and boom raising.

As a comparative example, one possible arrangement is that the flow rate of the hydraulic fluid to the swing hydraulic motor 5 is reduced to thereby reduce torque of the swing hydraulic motor 5 during the combined operation involving swing and boom raising. This arrangement, however, causes hunting to tend to occur, resulting in degraded operability in combined operations. From the foregoing viewpoint, too, the present embodiment can achieve favorable operability in combined operations.

A second embodiment of the present invention will be described. In the present embodiment, like reference numerals refer to like parts described in the first embodiment and descriptions therefor will be omitted as appropriate.

Figure 7:
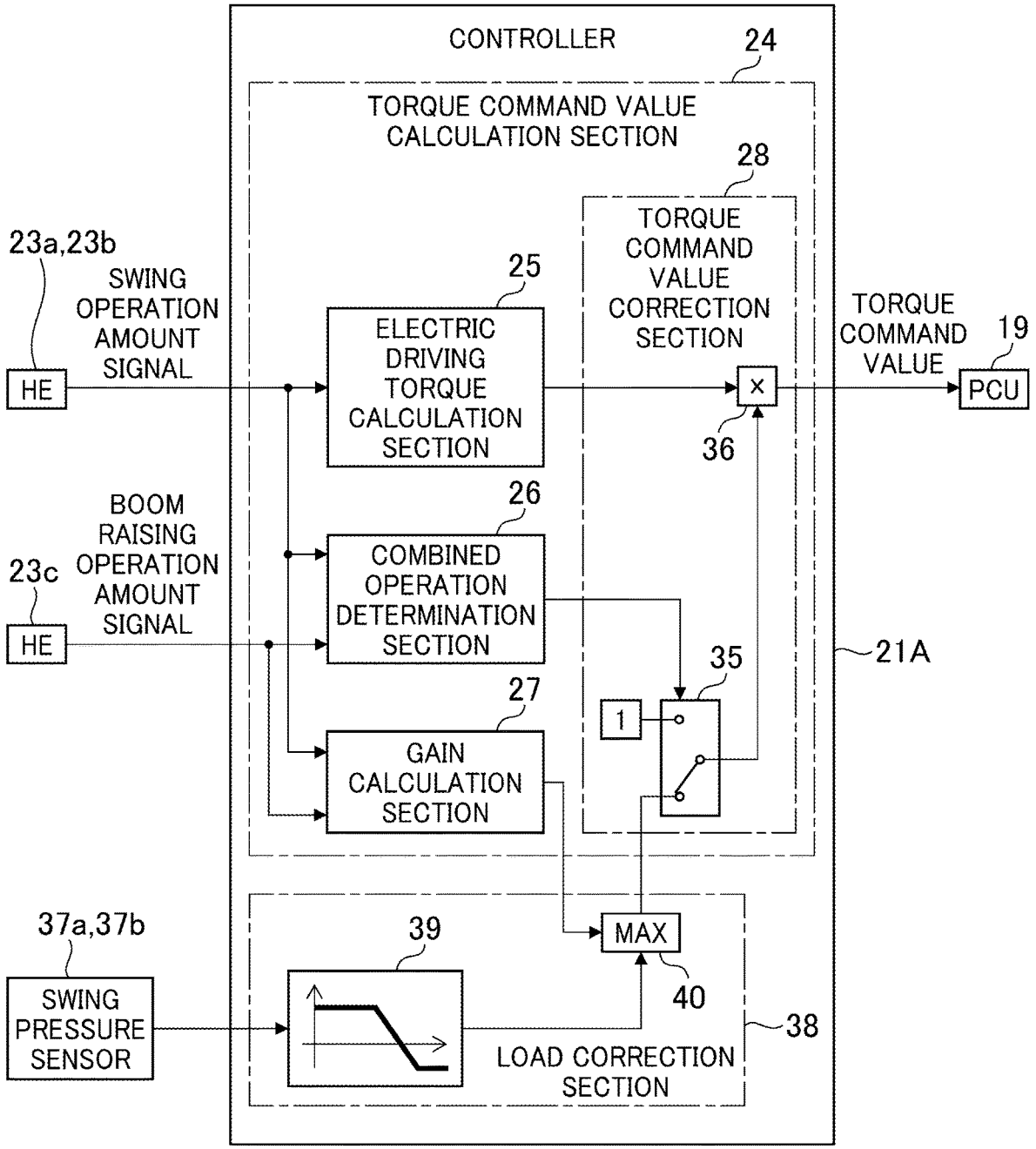
FIG. 7 is a block diagram of a processing function of a controller in a second embodiment of the present invention.

FIG. 7 is a block diagram of a processing function of a controller in the present embodiment.

In the present embodiment, swing pressure sensors 37*a* and 37*b* (pressure sensors) are disposed in lines through which hydraulic fluid is supplied to, and discharged from, the swing hydraulic motor 5 (see FIG. 2). Load pressure of the swing hydraulic motor 5 (swing load pressure) detected by the swing pressure sensor 37*a* or 37*b* is output to a controller 21A.

The controller 21A includes the torque command value calculation section 24 and a load correction section 38. On the basis of a swing operation amount signal of the operation lever device 15*a* applied from the pilot pressure sensor 23*a* or 23*b*, a boom raising operation amount signal of the operation lever device 15*b* applied from the pilot pressure sensor 23*c*, a swing speed signal applied from the inverter 19, and a detection value of the swing load pressure applied from the swing pressure sensor 37*a* or 37*b*, the controller 21A calculates a torque command value for controlling the electric driving torque or the electricity generating torque of the swing electric motor 6 and outputs the torque command value to the inverter 19.

As with the torque command value calculation section 24 in the first embodiment, the torque command value calculation section 24 includes the electric driving torque calculation section 25, the combined operation determination section 26, the gain calculation section 27, and the torque command value correction section 28.

The load correction section 38 includes a limiting gain calculation table 39 and a maximum value selection section 40. The load correction section 38 thereby corrects the gain calculated by the gain calculation section 27 (in other words, the gain obtained as a result of a determination made that the swing load pressure is higher than the boom load pressure when, for example, the swing load pressure estimated value is greater than the boom load pressure estimated value) using the detection value of the swing load pressure.

The limiting gain calculation table 39 represents a relation established in advance between the detection value of the swing load pressure and the limiting gain. Specifically, as shown in FIG. 7, the relation is set such that the limiting gain on the ordinate remains a positive value when the detection value of the swing load pressure on the abscissa is smaller than a predetermined value and that the limiting gain increases with a decreasing detection value of the swing load pressure from the predetermined value. The relation is further set such that the limiting gain remains a negative value when the detection value of the swing load pressure is greater than the predetermined value and that the limiting gain decreases with an increasing detection value of the swing load pressure from the predetermined value. It is noted that the limiting gain may have a maximum value of "1"; however, the maximum value is set to less than "1" in the present embodiment.

The load correction section 38 uses the limiting gain calculation table 39 to calculate the limiting gain from the detection value of the swing load pressure. The load correction section 38 causes the maximum value selection section 40 to select either the limiting gain calculated using the limiting gain calculation table 39 or the gain calculated by the gain calculation section 27, whichever is greater (specifically, corrects the gain), and outputs the value to the torque command value correction section 28.

When the combined operation determination section 26 determines that the combined operation involving swing and boom raising is being performed, the gain changeover section 35 of the torque command value correction section 28 selects the gain corrected by the load correction section 38 and outputs the corrected gain to the multiplication section 36. The multiplication section 36 multiplies the electric driving torque value calculated by the electric driving torque calculation section 25 by the gain corrected by the load correction section 38 to thereby find a torque command value and outputs the torque command value to the inverter 19. To state the foregoing differently, a value obtained by multiplying the electric driving torque value calculated by the electric driving torque calculation section 25 by the gain corrected by the load correction section 38 is set as the torque command value and the torque command value is output to the inverter 19.

Figure 8:
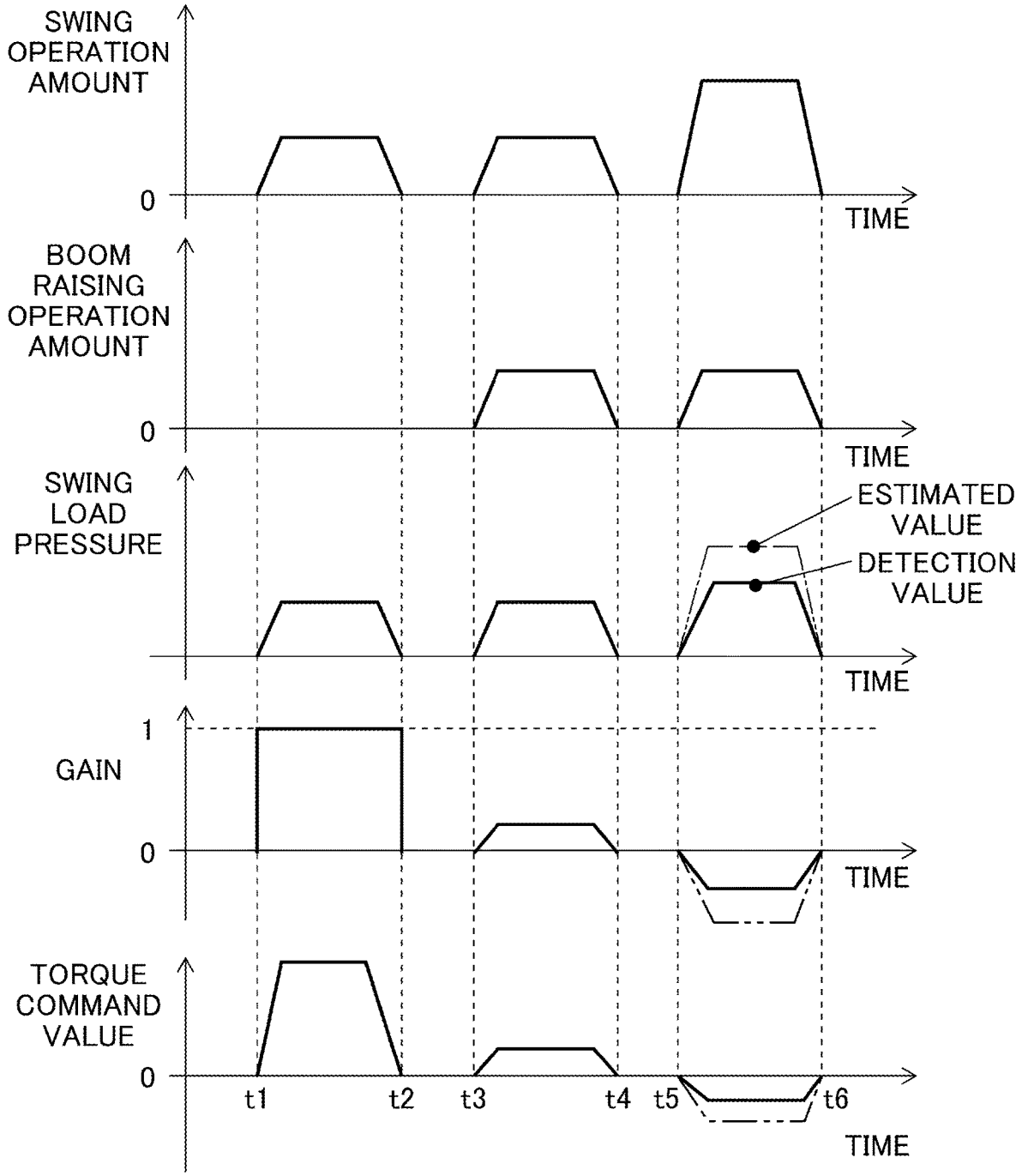
FIG. 8 is a timing chart for illustrating operations in the second embodiment of the present invention.

Operations and effects of the present embodiment will be described below. FIG. 8 is a timing chart for illustrating operations in the present embodiment.

Operations during a period of time from time t1 to time t2 and a period of time from time t3 to time t4 are the same as those in the first embodiment.

For a period of time from time t5 to time t6, a combined operation involving swing and boom raising is being performed. When the swing operation amount is relatively large as shown in FIG. 8, the swing load pressure estimated value is relatively great and is greater than the boom load pressure estimated value. As a result, the gain calculated by the gain calculation section 27 of the controller 21A is a negative value. Because, however, of factors including posture of the work implement 3, the swing load pressure estimated value may be greater than the detection value of the swing load pressure. At this time, the load correction section 38 of the controller 21A calculates the limiting gain from the detection value of the swing load pressure and the limiting gain is a value (a negative value in FIG. 8) greater than the gain calculated by the gain calculation section 27. Thus, the limiting gain in place of the gain calculated by the gain calculation section 27 is selected to correct the gain. Then, the torque command value correction section 28 multiplies the electric driving torque value calculated by the electric driving torque calculation section 25 by the gain corrected by the load correction section 38 to thereby find a torque command value and outputs the torque command value to the inverter 19.

The swing structure 2, because rotating integrally with the work implement 3, has a moment of inertia variable according to posture of the work implement 3 and a loading state of the bucket 9 and, accordingly, the load pressure of the swing hydraulic motor 5 (swing load pressure) developing when the swing structure 2 is driven varies. Specifically, when the work implement 3 takes an extended position (maximum reach) or when a live load of the bucket 9 is large, the swing structure 2 has a large moment of inertia and the swing load pressure is high. When the work implement 3 takes a contracted position (minimum reach), or when the live load of the bucket 9 is small or the bucket 9 is in an empty state, the swing structure 2 has a small moment of inertia and the swing load pressure is low.

In the present embodiment, when the gain calculated by the gain calculation section 27 is greater than the limiting gain calculated using the limiting gain calculation table 39, the effect identical to the effect achieved by the first embodiment can be achieved. When the limiting gain calculated using the limiting gain calculation table 39 is greater than the gain calculated by the gain calculation section 27 because of the moment of inertia involved of the swing structure 2, the gain is corrected on the basis of the detection value of the swing load pressure. The operability in the combined operation involving swing and boom raising can thereby be further enhanced.

It is noted that the second embodiment assumes a case in which the swing load pressure estimated value is greater than the detection value of the swing load pressure and the second embodiment includes the maximum value selection section 40 that selects either the limiting gain calculated using the limiting gain calculation table 39 or the gain calculated by the gain calculation section 27, whichever is greater. The foregoing configuration is, however, illustrative only and not limiting and modifications that would fall within the intent and spirit of the present invention can be made. Specifically, a case may be assumed in which the swing load pressure estimated value is lower than the detection value of the swing load pressure upon, for example, rising of the swing load pressure. Thus, a possible configuration includes, instead of the maximum value selection section 40, a minimum value selection section that selects either the limiting gain calculated using the limiting gain calculation table 39 or the gain calculated by the gain calculation section 27, whichever is smaller (which is similar to the third embodiment to be described later). The same effect as that described above can also be achieved in this modification.

The second embodiment has been described as including the swing pressure sensors 37*a* and 37*b* that detect the load pressure of the swing hydraulic motor 5 (in other words, pressure across the swing direction control valve and the swing hydraulic motor 5). The foregoing configuration is, however, illustrative only and not limiting and modifications that would fall within the intent and spirit of the present invention can be made. Specifically, in cases in which the swing hydraulic motor 5 is the only actuator to which hydraulic fluid from the hydraulic pump 16*a* is supplied or in which the hydraulic fluid from the hydraulic pump 16*a* is supplied only to the swing hydraulic motor 5 and none of other actuators when the combined operation involving swing and boom raising is performed, a possible configuration includes a delivery pressure sensor 41*a* (see FIG. 2) that detects delivery pressure of the hydraulic pump 16*a* (in other words, pressure across the hydraulic pump 16*a* and the swing direction control valve) as a value identical to the value of the load pressure of the swing hydraulic motor 5. The controller may, in this case, use the detection value of the delivery pressure sensor 41*a* in place of the detection value of the swing pressure sensor 37*a* or 37*b*. The same effect as that described above can also be achieved in this modification.

A third embodiment of the present invention will be described. In the present embodiment, like reference numerals refer to like parts described in the first and second embodiments and descriptions therefor will be omitted as appropriate.

Figure 9:
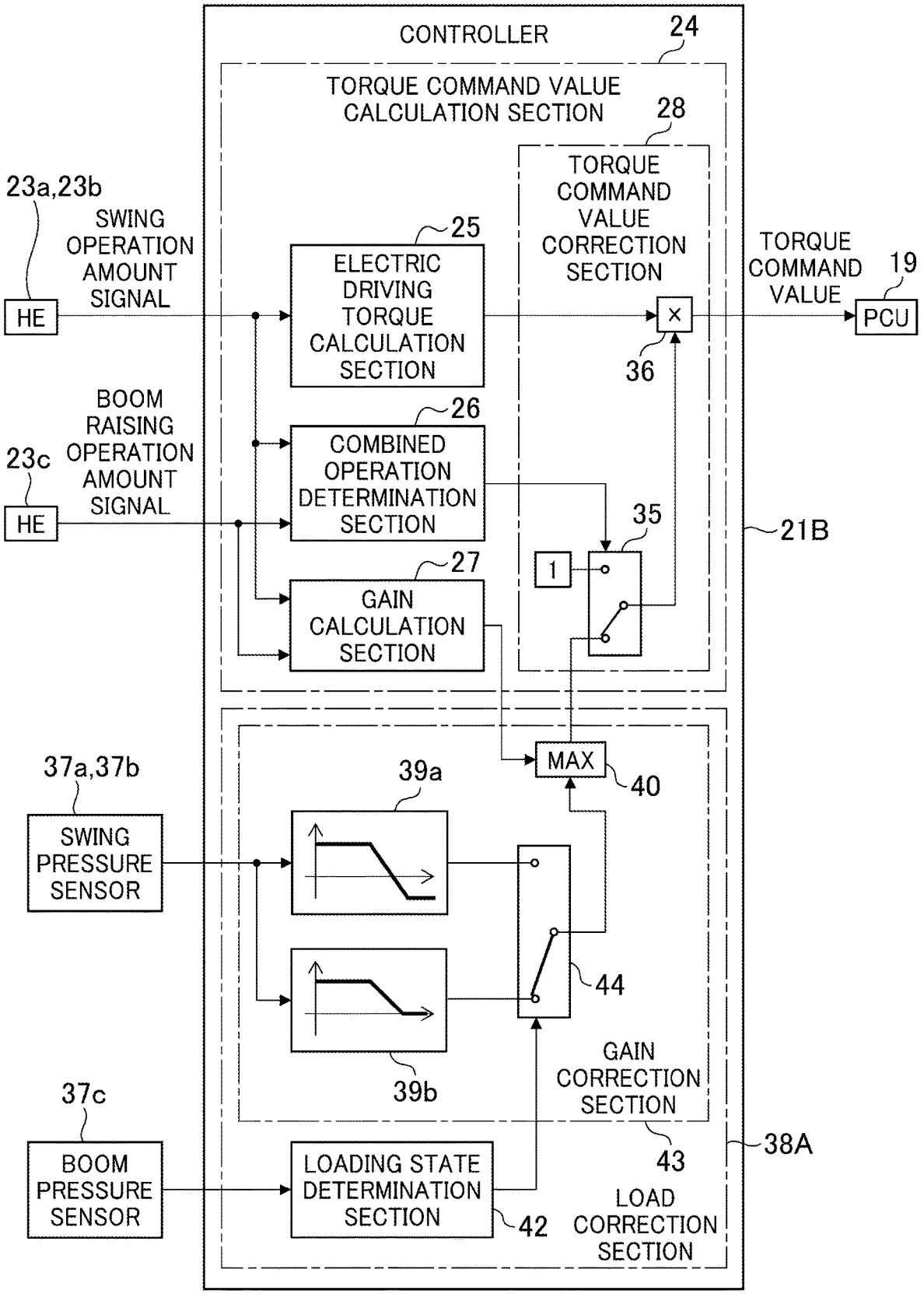
FIG. 9 is a block diagram of a processing function of a controller in a third embodiment of the present invention.

FIG. 9 is a block diagram of a processing function of a controller in the present embodiment.

As in the second embodiment, the present embodiment includes the swing pressure sensors 37*a* and 37*b* (first pressure sensors). The load pressure of the swing hydraulic motor 5 (swing load pressure) detected by the swing pressure sensor 37*a* or 37*b* is output to a controller 21B.

A boom pressure sensor 37*c* (second pressure sensor) is disposed in a line through which hydraulic fluid is supplied to, and discharged from, a bottom side of the boom cylinder 10. The load pressure of the boom cylinder 10 (boom load pressure) detected by the boom pressure sensor 37*c* is output to the controller 21B.

The controller 21B includes the torque command value calculation section 24 and a load correction section 38A. On the basis of a swing operation amount signal of the operation lever device 15*a* applied from the pilot pressure sensor 23*a* or 23*b*, a boom raising operation amount signal of the operation lever device 15*b* applied from the pilot pressure sensor 23*c*, a swing speed signal applied from the inverter 19, a detection value of the swing load pressure applied from the swing pressure sensor 37*a* or 37*b*, and a detection value of the boom load pressure applied from the boom pressure sensor 37*c*, the controller 21B calculates a torque command value for controlling the electric driving torque or the electricity generating torque of the swing electric motor 6 and outputs the torque command value to the inverter 19.

As with the torque command value calculation section 24 in the first embodiment, the torque command value calculation section 24 includes the electric driving torque calculation section 25, the combined operation determination section 26, the gain calculation section 27, and the torque command value correction section 28.

The load correction section 38A includes a loading state determination section 42 and a gain correction section 43. The load correction section 38A thereby corrects the gain calculated by the gain calculation section 27 (in other words, the gain obtained as a result of a determination made that the swing load pressure is higher than the boom load pressure when, for example, the swing load pressure estimated value is greater than the boom load pressure estimated value) using the detection value of the swing load pressure and the detection value of the boom load pressure.

The loading state determination section 42 determines the loading state of the bucket 9 using the detection value of the boom load pressure. Specifically, if the detection value of the boom load pressure reaches a set value (e.g., 20 MPa), the loading state determination section 42 determines that the bucket 9 is in a loaded state; if the detection value of the boom load pressure is yet to reach the set value, the loading state determination section 42 determines that the bucket 9 is in an empty state. The loading state determination section 42 outputs the result of the determination made to the gain correction section 43.

The gain correction section 43 includes a limiting gain calculation table for an empty state 39*a*, a limiting gain calculation table for a loaded state 39*b*, a table selection section 44, and a maximum value selection section 40.

The limiting gain calculation table for an empty state 39*a* represents a relation established in advance between the detection value of the swing load pressure and the limiting gain. Specifically, as shown in FIG. 9, the relation is set such that the limiting gain on the ordinate remains a positive value when the detection value of the swing load pressure on the abscissa is smaller than a predetermined value (which corresponds to the boom load pressure when the bucket is determined to be in an empty state) and that the limiting gain increases with a decreasing detection value of the swing load pressure from the predetermined value. The relation is further set such that the limiting gain remains a negative value when the detection value of the swing load pressure is greater than the predetermined value and that the limiting gain decreases with an increasing detection value of the swing load pressure from the predetermined value.

The limiting gain calculation table for a loaded state 39*b* represents, as with the limiting gain calculation table for an empty state 39*a*, a relation established in advance between the detection value of the swing load pressure and the limiting gain. Specifically, as shown in FIG. 9, the relation is set such that the limiting gain on the ordinate remains a positive value when the detection value of the swing load pressure on the abscissa is smaller than a predetermined value and that the limiting gain increases with a decreasing detection value of the swing load pressure from the predetermined value. The relation is further set such that the limiting gain remains zero when the detection value of the swing load pressure is greater than the predetermined value. In addition, the limiting gain of the limiting gain calculation table for a loaded state 39*b* is set to be greater than the limiting gain of the limiting gain calculation table for an empty state 39*a* when the detection value of the swing load pressure is in an identical condition. This responds to the characteristic depicted in FIG. 13.

The following is the reason why, in the limiting gain calculation table for a loaded state 39*b*, the relation is set such that the minimum value of the limiting gain corresponding to the maximum value of the detection value of the swing load pressure is zero. In the present embodiment, the relief valve 22 has relief pressure (which, specifically, corresponds to the maximum value of the swing load pressure) set to a value identical to the value of the boom load pressure (e.g., 20 MPa) when the bucket 9 is in the loaded state during a boom raising operation. Thus, when the bucket 9 is in the loaded state during a combined operation involving swing and boom and the swing load pressure is the maximum value, the torque command value needs to be zero in order to achieve balance with the boom load pressure.

The table selection section 44 selects the limiting gain calculation table for an empty state 39*a* when the loading state determination section 42 determines that the bucket 9 is in the loaded state and selects the limiting gain calculation table for a loaded state 39*b* when the loading state determination section 42 determines that the bucket 9 is in the empty state.

The gain correction section 43 uses the limiting gain calculation table for an empty state 39*a* or the limiting gain calculation table for a loaded state 39*b* selected by the table selection section 44 to thereby calculate the limiting gain from the detection value of the swing load pressure. The maximum value selection section 40 then selects either the limiting gain calculated using the limiting gain calculation table for an empty state 39*a* or the limiting gain calculation table for a loaded state 39*b* or the gain calculated by the gain calculation section 27, whichever is greater (specifically, corrects the gain), and outputs the selected value to the torque command value correction section 28.

When the combined operation determination section 26 determines that the combined operation involving swing and boom raising is being performed, the gain changeover section 35 of the torque command value correction section 28 selects the gain corrected by the gain correction section 43 and outputs the corrected gain to the multiplication section 36. The multiplication section 36 multiplies the electric driving torque value calculated by the electric driving torque calculation section 25 by the gain corrected by the gain correction section 43 to thereby find a torque command value and outputs the torque command value to the inverter 19. To state the foregoing differently, a value obtained by multiplying the electric driving torque value calculated by the electric driving torque calculation section 25 by the gain corrected by the gain correction section 43 is set as the torque command value and the torque command value is output to the inverter 19.

Figure 10:
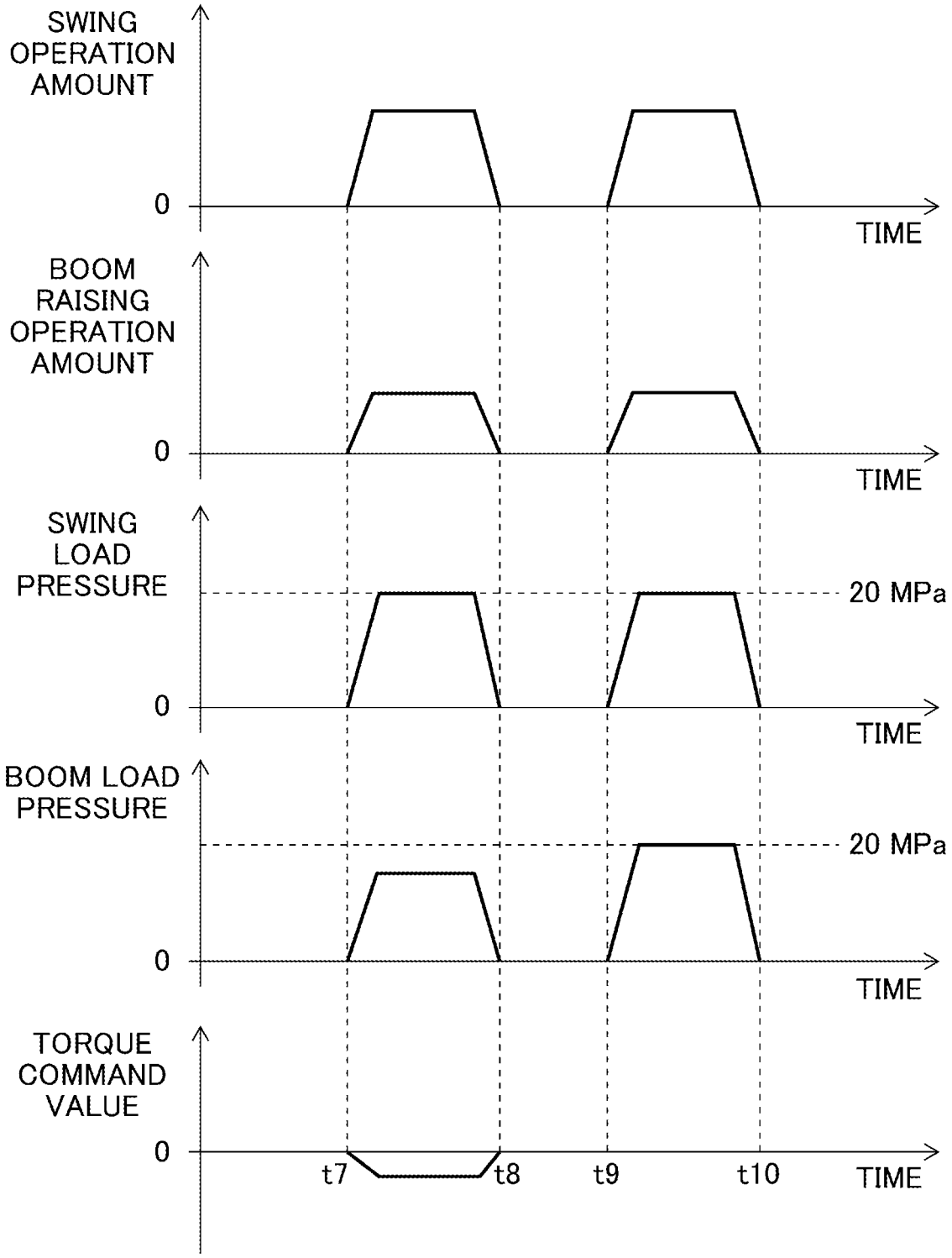
FIG. 10 is a timing chart for illustrating operations in the third embodiment of the present invention.

Operations and effects of the present embodiment will be described below. FIG. 10 is a timing chart for illustrating operations in the present embodiment.

For a period of time from time t7 to time t8, a combined operation involving swing and boom raising is being performed. Because the detection value of the boom load pressure is less than the set value (20 MPa) as shown in FIG. 10, the loading state determination section 42 of the controller 21B determines that the bucket 9 is in the empty state. The gain correction section 43 selects the limiting gain calculation table for an empty state 39*a* and uses the limiting gain calculation table for an empty state 39*a* to calculate the limiting gain from the detection value of the swing load pressure. If the detection value of the swing load pressure has reached the maximum value (20 MPa) at this time as shown in FIG. 10, the limiting gain is a negative value. If this limiting gain value is greater than the gain calculated by the gain calculation section 27, the limiting gain instead of the gain calculated by the gain calculation section 27 is selected. The torque command value correction section 28 multiplies the electric driving torque value calculated by the electric driving torque calculation section 25 by the gain (negative value) corrected by the gain correction section 43 to thereby find a torque command value (negative value) and outputs the torque command value to the inverter 19. The swing electric motor 6 is thereby caused to generate electricity.

Figure 11:
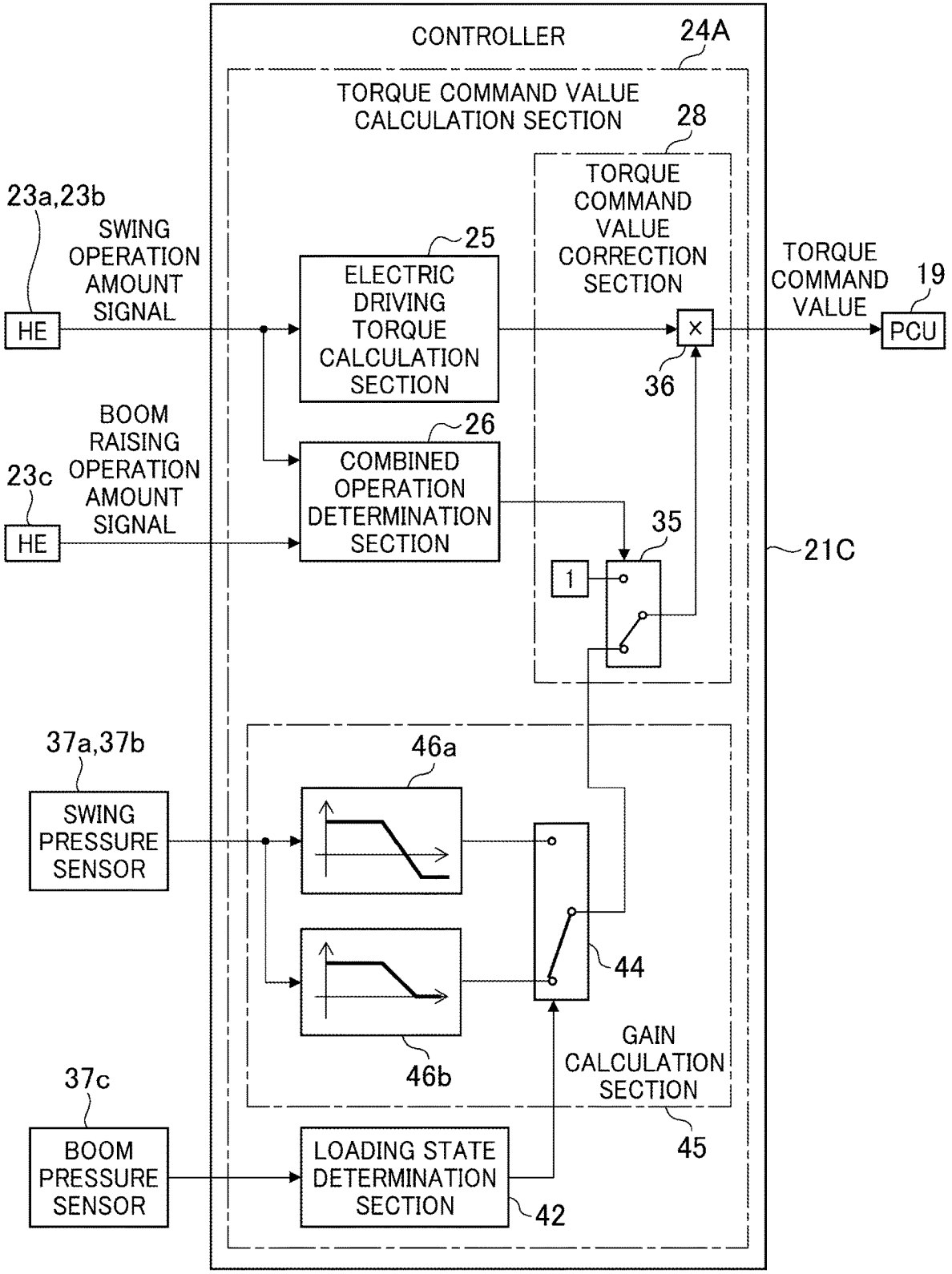
FIG. 11 is a block diagram of a processing function of a controller in a fourth embodiment of the present invention.
Figure 12:
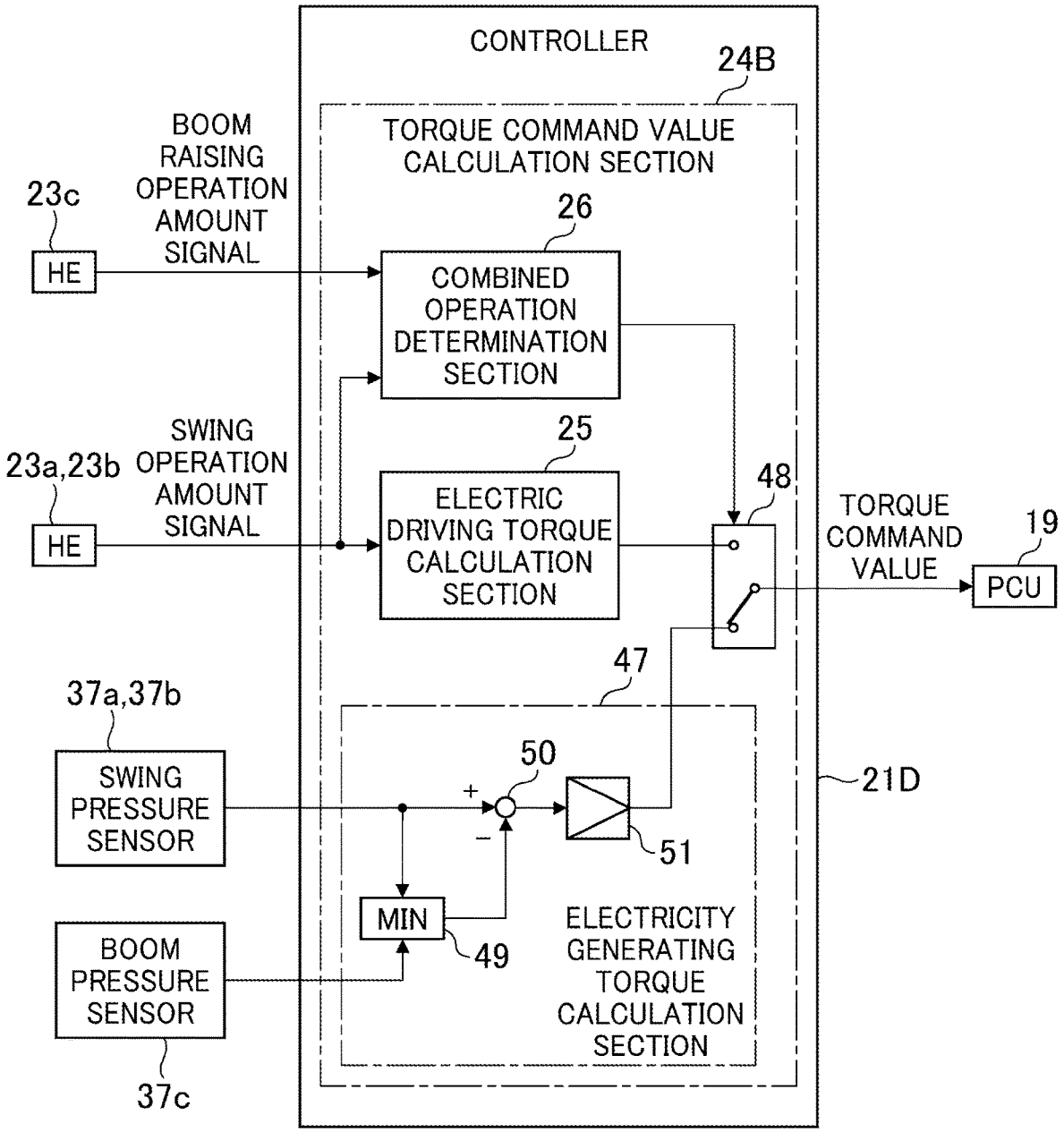
FIG. 12 is a block diagram of a processing function of a controller in a fifth embodiment of the present invention.

For a period of time from time t9 to time t10, a combined operation involving swing and boom raising is being performed. Because the detection value of the boom load pressure has reached the set value (20 MPa) as shown in FIG. 10, the loading state determination section 42 of the controller 21B determines that the bucket 9 is in the loaded state. The gain correction section 43 selects the limiting gain calculation table for a loaded state 39*b* and uses the limiting gain calculation table for a loaded state 39*b* to calculate the limiting gain from the detection value of the swing load pressure. If the detection value of the swing load pressure has reached the maximum value (20 MPa) at this time as shown in FIG. 11, the limiting gain is zero. If this limiting gain value is greater than the gain calculated by the gain calculation section 27, the limiting gain instead of the gain calculated by the gain calculation section 27 is selected. The torque command value correction section 28 multiplies the electric driving torque value calculated by the electric motor driving calculation section 25 by the gain (zero) corrected by the gain correction section 43 to thereby find a torque command value (zero) and outputs the torque command value to the inverter 19. The swing electric motor 6 is thereby caused to neither perform electrical driving nor generate electricity.

In the present embodiment that is configured as described above, when the gain calculated by the gain calculation section 27 is greater than the limiting gain calculated using the limiting gain calculation table for an empty state 39*a* or the limiting gain calculation table for a loaded state 39*b*, the effect identical to the effect achieved by the first embodiment can be achieved. When the limiting gain calculated using the limiting gain calculation table for an empty state 39*a* or the limiting gain calculation table for a loaded state 39*b* is greater than the gain calculated by the gain calculation section 27 because of the moment of inertia involved of the swing structure 2, the gain is corrected on the basis of the detection value of the swing load pressure and the detection value of the boom load pressure. The operability in the combined operation involving swing and boom raising can thereby be further enhanced.

It is noted that the third embodiment has been described for a case in which the minimum value of the limiting gain in the limiting gain calculation table for a loaded state 39*b* is zero; however, the case is illustrative only and not limiting and modifications that would fall within the intent and spirit of the present invention can be made.

As one modification, the relief valve 22 may have relief pressure set to a value lower than the value of the boom load pressure (e.g., 20 MPa) when the bucket 9 is in the loaded state during a boom raising operation. In such a case, the minimum value of the limiting gain in the limiting gain calculation table for a loaded state 39*b* is made greater than zero. To explain arrangement using a specific numeric value: assume that q denotes the capacity of the swing hydraulic motor 5 and the relief pressure of the relief valve 22 is set to 18 MPa. Then, the torque of the swing hydraulic motor 5 when the swing load pressure is the maximum is "18×q." To obtain the operability in combined operations comparable to that of the conventional hydraulic excavator, the total torque of the swing hydraulic motor 5 and the swing electric motor 6 needs to be "20×q," so that the torque command value of a swing electric torque motor needs to be "2×q." Thus, the minimum value of the limiting gain is set so that the torque command value of the swing electric motor 6 is "2×q."

As another modification, the relief valve 22 may have relief pressure set to a value higher than the value of the boom load pressure (e.g., 20 MPa) when the bucket 9 is in the loaded state during a boom raising operation. In such a case, the minimum value of the limiting gain in the limiting gain calculation table for a loaded state 39*b* is made smaller than zero. To explain arrangement using a specific numeric value: assume that q denotes the capacity of the swing hydraulic motor 5 and the relief pressure of the relief valve 22 is set to 22 MPa. Then, the torque of the swing hydraulic motor 5 when the swing load pressure is the maximum is "22×q." To obtain the operability in combined operations comparable to that of the conventional hydraulic excavator, the total torque of the swing hydraulic motor 5 and the swing electric motor 6 needs to be "20×q," so that the torque command value of the swing electric torque motor needs to be "−2×q." Thus, the minimum value of the limiting gain is set so that the torque command value of the swing electric motor 6 is "−2×q."

It is noted that the third embodiment has been described for a case in which the loading state determination section 42 determines the loading state as selected from among the two loading states (loaded or empty state) and the gain correction section 43 includes the limiting gain calculation table for an empty state 39*a* and the limiting gain calculation table for a loaded state 39*b* that are associated with the respective loading states; however, the case is illustrative only and not limiting and modifications that would fall within the intent and spirit of the present invention can be made. Specifically, the loading state determination section may determine the loading state as selected from among three or more loading states according to the load and the gain correction section may include control gain calculation tables associated with the respective loading states. The modifications can still achieve the effects identical to those described above.

A fourth embodiment of the present invention will be described. In the present embodiment, like reference numerals refer to like parts described in the first to third embodiments and descriptions therefor will be omitted as appropriate.

FIG. 11 is a block diagram of a processing function of a controller in the present embodiment.

As with the third embodiment, the present embodiment includes the swing pressure sensors 37*a* and 37*b* and the load pressure of the swing hydraulic motor 5 (swing load pressure) detected by the swing pressure sensor 37*a* or 37*b* is output to a controller 21C. Additionally, as with the third embodiment, the present embodiment includes the boom pressure sensor 37*c* and the load pressure of the boom cylinder 10 (boom load pressure) detected by the boom pressure sensor 37*c* is output to the controller 21C.

The controller 21C includes a torque command value calculation section 24A. On the basis of a swing operation amount signal of the operation lever device 15*a* applied from the pilot pressure sensor 23*a* or 23*b*, a boom raising operation amount signal of the operation lever device 15*b* applied from the pilot pressure sensor 23*c*, a swing speed signal applied from the inverter 19, a detection value of the swing load pressure applied from the swing pressure sensor 37*a* or 37*b*, and a detection value of the boom load pressure applied from the boom pressure sensor 37*c*, the controller 21C calculates a torque command value for controlling the electric driving torque or the electricity generating torque of the swing electric motor 6 and outputs the torque command value to the inverter 19.

The torque command value calculation section 24A includes, as with the torque command value calculation section 24 in the first embodiment, the electric driving torque calculation section 25, the combined operation determination section 26, and the torque command value correction section 28. The torque command value calculation section 24A further includes a gain calculation section 45 of feedback control in place of the gain calculation section 27 of feed forward control. In addition, the torque command value calculation section 24A further includes the loading state determination section 42 as with the load correction section 38A in the third embodiment.

The gain calculation section 45 includes a gain calculation table for an empty state 46*a*, a gain calculation table for a loaded state 46*b*, and a table selection section 44.

The gain calculation table for an empty state 46*a* represents a relation established in advance between the detection value of the swing load pressure and the gain. Specifically, as shown in FIG. 11, the relation is set such that the gain on the ordinate remains a positive value when the detection value of the swing load pressure on the abscissa is smaller than a predetermined value (which corresponds to the boom load pressure when the bucket is determined to be in an empty state) and that the gain increases with a decreasing detection value of the swing load pressure from the predetermined value. The relation is further set such that the gain remains a negative value when the detection value of the swing load pressure is greater than the predetermined value and that the gain decreases with an increasing detection value of the swing load pressure from the predetermined value. Negative gain is thereby output when the detection value of the swing load pressure is greater than the detection value of the boom load pressure. The absolute value of the negative gain increases with an increasing difference between the detection value of the swing load pressure and the detection value of the boom load pressure.

As with the gain calculation table for an empty state 46*a*, the gain calculation table for a loaded state 46*b* represents a relation established in advance between the detection value of the swing load pressure and the gain. Specifically, as shown in FIG. 11, the relation is set such that the gain on the ordinate remains a positive value when the detection value of the swing load pressure on the abscissa is smaller than a predetermined value and that the gain increases with a decreasing detection value of the swing load pressure from the predetermined value. The relation is further set such that the gain remains zero when the detection value of the swing load pressure is greater than the predetermined value. In addition, the gain of the gain calculation table for a loaded state 46*b* is set to be greater than the gain of the gain calculation table for an empty state 46*a* when the detection value of the swing load pressure is in an identical condition. This responds to the characteristic depicted in FIG. 13.

The same reason as for the limiting gain calculation table for a loaded state 39*b* of the third embodiment applies to why, in the gain calculation table for a loaded state 46*b*, the relation is set such that the minimum value of the gain corresponding to the maximum value of the detection value of the swing load pressure is zero. Thus, as for the limiting gain calculation table for a loaded state 39*b* of the third embodiment, the minimum value of the gain may be changed according to the relief pressure of the relief valve 22.

The table selection section 44 selects the gain calculation table for an empty state 46*a* when the loading state determination section 42 determines that the bucket 9 is in the loaded state and selects the gain calculation table for a loaded state 46*b* when the loading state determination section 42 determines that the bucket 9 is in the empty state. The gain calculation section 45 uses the gain calculation table for an empty state 46*a* or the gain calculation table for a loaded state 46*b* selected by the table selection section 44 to calculate the gain from the detection value of the swing load pressure and outputs the gain to the torque command value correction section 28.

When the combined operation determination section 26 determines that the combined operation involving swing and boom raising is being performed, the gain changeover section 35 of the torque command value correction section 28 selects the gain calculated by the gain calculation section 45 and outputs the gain to the multiplication section 36. The multiplication section 36 multiplies the electric driving torque value calculated by the electric driving torque calculation section 25 by the gain calculated by the gain calculation section 45 to thereby find a torque command value and outputs the torque command value to the inverter 19. To state the foregoing differently, a value obtained by multiplying the electric driving torque value calculated by the electric driving torque calculation section 25 by the gain calculated by the gain calculation section 45 is set as the torque command value and the torque command value is output to the inverter 19.

In the present embodiment that is configured as described above, too, the operability in the combined operation involving swing and boom raising comparable to that of the conventional hydraulic excavator can be achieved as in the first to third embodiments. Specifically, the operability in the combined operation having the characteristic shown in FIG. 13 can be achieved.

It is noted that the fourth embodiment has been described for a case in which the loading state determination section 42 determines the loading state as selected from among the two loading states (loaded or empty state) and the gain calculation section 45 includes the gain calculation table for an empty state 46*a* and the gain calculation table for a loaded state 46*b* that are associated with the respective loading states; however, the case is illustrative only and not limiting and modifications that would fall within the intent and spirit of the present invention can be made. Specifically, the loading state determination section may determine the loading state as selected from among three or more loading states according to the load and the gain calculation section may include gain calculation tables associated with the respective loading states. The modifications can still achieve the effects identical to those described above.

A fifth embodiment of the present invention will be described. In the present embodiment, like reference numerals refer to like parts described in the first to fourth embodiments and descriptions therefor will be omitted as appropriate.

As with the third and fourth embodiments, the present embodiment includes the swing pressure sensors 37*a* and 37*b* and the load pressure of the swing hydraulic motor 5 (swing load pressure) detected by the swing pressure sensor 37*a* or 37*b* is output to a controller 21D. Additionally, as with the third and fourth embodiments, the present embodiment includes the boom pressure sensor 37*c* and the load pressure of the boom cylinder 10 (boom load pressure) detected by the boom pressure sensor 37*c* is output to the controller 21D.

The controller 21D includes a torque command value calculation section 24B. On the basis of a swing operation amount signal of the operation lever device 15*a* applied from the pilot pressure sensor 23*a* or 23*b*, a boom raising operation amount signal of the operation lever device 15*b* applied from the pilot pressure sensor 23*c*, a swing speed signal applied from the inverter 19, a detection value of the swing load pressure applied from the swing pressure sensor 37*a* or 37*b*, and a detection value of the boom load pressure applied from the boom pressure sensor 37*c*, the controller 21D calculates a torque command value for controlling the electric driving torque or the electricity generating torque of the swing electric motor 6 and outputs the torque command value to the inverter 19.

The torque command value calculation section 24B includes, as with the torque command value calculation section 24A in the fourth embodiment, the electric driving torque calculation section 25 and the combined operation determination section 26. The torque command value calculation section 24B further includes an electricity generating torque calculation section 47 and a torque command value changeover section 48.

The electricity generating torque calculation section 47 includes a minimum value selection section 49, a subtraction section 50, and a PI control calculation section 51.

The subtraction section 50 subtracts, from the detection value of the swing load pressure, the detection value of the swing load pressure or the detection value of the boom load pressure, whichever is smaller, selected by the minimum value selection section 49 to thereby calculate differential pressure. When, for example, the detection value of the swing load pressure is smaller than the detection value of the boom load pressure, the differential pressure (zero) is between the two detection values of the swing load pressure. When the detection value of the swing load pressure is greater than the detection value of the boom load pressure, the differential pressure is between the detection value of the swing load pressure and the detection value of the boom load pressure. The PI control calculation section 51 calculates the electricity generating torque (negative torque) of the swing electric motor 6 on the basis of the differential pressure calculated by the subtraction section 50 through PI control calculation (specifically, using capacity q of the swing hydraulic motor 5 for proportional gain). Specifically, the calculation is performed such that the absolute value of the electricity generating torque of the swing electric motor 6 increases with increasing differential pressure between the detection value of the swing load pressure and the detection value of the boom load pressure.

When the combined operation determination section 26 determines that the combined operation involving swing and boom raising is not being performed, the torque command value changeover section 48 selects the electric driving torque calculated by the electric driving torque calculation section 25 as a positive torque command value and outputs the torque command value to the inverter 19. The swing electric motor 6 is thereby caused to perform electrical driving (powering) and the electric driving torque (positive torque) thereof is controlled.

When the combined operation determination section 26 determines that the combined operation involving swing and boom raising is being performed, the torque command value changeover section 48 selects the electricity generating torque calculated by the electricity generating torque calculation section 47 as a negative torque command value and outputs the torque command value to the inverter 19. The swing electric motor 6 is thereby caused to generate electricity (perform regeneration) and the electricity generating torque (negative torque) thereof is controlled.

As described above, in the present embodiment, when the detection value of the swing load pressure is greater than the detection value of the boom load pressure (when the swing load pressure is determined to be higher than the boom load pressure) during the combined operation involving swing and boom raising, the swing electric motor 6 is caused to generate electricity to thereby reduce the swing torque (total torque of the swing hydraulic motor 5 and the swing electric motor 6) and to reduce the swing speed. This allows the swing hydraulic motor 5 to be rotated at a speed equivalent to a speed when driven with the boom load pressure. Thus, operability in the combined operation involving swing and boom raising similar to the operability achieved by the conventional hydraulic excavator can be achieved. Specifically, the operability in the combined operation having the characteristic shown in FIG. 13 can be achieved.

It is noted that the third to fifth embodiments each have been described for a configuration that includes the swing pressure sensors 37*a* and 37*b* that detect the load pressure of the swing hydraulic motor 5 (in other words, pressure across the swing direction control valve and the swing hydraulic motor 5) and the boom pressure sensor 37*c* that detects the load pressure of the boom cylinder 10 (in other words, pressure across the boom direction control valve and the boom cylinder 10). The configuration is, however, illustrative only and not limiting and modifications that would fall within the intent and spirit of the present invention can be made. Specifically, in cases in which the swing hydraulic motor 5 is the only actuator to which the hydraulic fluid from the hydraulic pump 16*a* is supplied or in which the hydraulic fluid from the hydraulic pump 16*a* is supplied only to the swing hydraulic motor 5 and none of other actuators when the combined operation involving swing and boom raising is performed, a possible configuration includes the delivery pressure sensor 41*a* (see FIG. 2) that detects delivery pressure of the hydraulic pump 16*a* (in other words, pressure across the hydraulic pump 16*a* and the swing direction control valve) as a value identical to the value of the load pressure of the swing hydraulic motor 5. Additionally, in cases in which the boom cylinder 10 is the only actuator to which the hydraulic fluid from the hydraulic pump 16*b* is supplied or in which the hydraulic fluid from the hydraulic pump 16*b* is supplied only to the boom cylinder 10 and none of other actuators when the combined operation involving swing and boom raising is performed, a possible configuration includes a delivery pressure sensor 41*b* (see FIG. 2) that detects delivery pressure of the hydraulic pump 16*b* (in other words, pressure across the hydraulic pump 16*b* and the boom direction control valve) as a value identical to the value of the load pressure of the boom cylinder 10. The controller may, in these cases, use the detection value of the delivery pressure sensor 41*a* in place of the detection value of the swing pressure sensor 37*a* or 37*b* and use the detection value of the delivery pressure sensor 41*b* in place of the detection value of the swing pressure sensor 37*c*. The same effect as that described above can also be achieved in these modifications.

Additionally, the first to fifth embodiments each have been described for a configuration that includes, as the first operation sensors, the pilot pressure sensors 23*a* and 23*b* that detect the clockwise swing operation amount signal and the counterclockwise swing operation amount signal (hydraulic signals), respectively, of the operation lever device 15*a* and converts the clockwise and counterclockwise swing operation amount signals to corresponding electric signals, and includes, as the second operation sensor, the pilot pressure sensor 23*c* that detects the boom raising operation amount signal (hydraulic signal) of the operation lever device 15*b* and converts the boom raising operation amount signal to a corresponding electric signal. The configuration is, however, illustrative only and not limiting and modifications that would fall within the intent and spirit of the present invention can be made. Specifically, a possible configuration includes, as the first operation sensor, a stroke sensor that detects an operation amount of the operation lever device 15*a* toward the front and an operation amount of the operation lever device 15*a* toward the rear and outputs a swing operation amount signal (electric signal). The possible configuration further includes, as the second operation sensor, a stroke sensor that detects an operation amount of the operation lever device 15*b* toward the rear and outputs a boom raising operation amount signal (electric signal). The controller may, in this case, use the operation amount signals from the stroke sensors in place of the operation amount signals from the pilot pressure sensors 23*a*, 23*b*, and 23*c*. The same effect as that described above can also be achieved in these modifications.

DESCRIPTION OF REFERENCE CHARACTERS

1: Track structure
2: Swing structure
3: Work implement
5: Swing hydraulic motor
6: Swing electric motor
7: Boom
8: Arm
9: Bucket
10: Boom cylinder
13: Engine (prime mover)
15*a*, 15*b*: Operation lever device
16*a*, 16*b*: Hydraulic pump
19: Inverter
21, 21A, 21B, 21C, 21D: Controller
22: Relief valve
23*a*, 23*b*, 23*c*: Pilot pressure sensor (operation sensor)
24, 24A, 24B: Torque command value calculation section
25: Electric driving torque calculation section
26: Combined operation determination section
27: Gain calculation section
28: Torque command value correction section
37*a*, 37*b*: Swing pressure sensor (pressure sensor)
37*c*: Boom pressure sensor (pressure sensor)
38, 38A: Load correction section
39, 39*a*, 39*b*: Limiting gain calculation table
41*a*, 41*b*: Delivery pressure sensor (pressure sensor)
42: Loading state determination section
43: Gain correction section
45: Gain calculation section
46*a*, 46*b*: Gain calculation table
47: Electricity generating torque calculation section
48: Torque command value changeover section

The invention claimed is:

1. A construction machine comprising:

a track structure;

a swing structure disposed swingably on the track structure;

a work implement including a boom, an arm, and a bucket, the boom being coupled vertically swingably to the swing structure;

a first hydraulic pump and a second hydraulic pump that are driven by a prime mover;

a boom cylinder driven by hydraulic fluid from the second hydraulic pump to thereby drive the boom;

a swing hydraulic motor driven by hydraulic fluid from the first hydraulic pump to thereby drive the swing structure;

a swing electric motor connected mechanically with the swing hydraulic motor;

an inverter that controls operation of the swing electric motor;

a controller that calculates a torque command value for controlling electric driving torque and electricity generating torque of the swing electric motor and outputs the torque command value to the inverter;

a first operation lever device that directs operation of the swing structure; and a second operation lever device that directs operation of the boom, wherein the controller includes a torque command value calculation section that receives inputs of a swing operation amount signal of the first operation lever device and a boom raising operation amount signal of the second operation lever device and that outputs a torque command value of the electricity generating torque of the swing electric motor to the inverter when load pressure of the swing hydraulic motor is determined to be higher than load pressure of the boom cylinder.

2. The construction machine according to claim 1, further comprising:

a first operation sensor that detects a swing operation amount signal of the first operation lever device; and a second operation sensor that detects a boom raising operation amount signal of the second operation lever device, wherein the torque command value calculation section estimates load pressure of the swing hydraulic motor and load pressure of the boom cylinder from the swing operation amount signal of the first operation lever device and the boom raising operation amount signal of the second operation lever device, respectively, and, when the estimated load pressure of the swing hydraulic motor is higher than the estimated load pressure of the boom cylinder, determines that the load pressure of the swing hydraulic motor is higher than the load pressure of the boom cylinder.

3. The construction machine according to claim 2, further comprising:

a first pressure sensor that detects load pressure of the swing hydraulic motor, wherein the controller further includes a load correction section that uses the load pressure of the swing hydraulic motor detected by the first pressure sensor to correct a result of a determination made by the torque command value calculation section.

4. The construction machine according to claim 2, further comprising:

a first pressure sensor that detects load pressure of the swing hydraulic motor; and a second pressure sensor that detects load pressure of the boom cylinder, wherein the controller further includes a load correction section that uses the load pressure of the swing hydraulic motor detected by the first pressure sensor and the load pressure of the boom cylinder detected by the second pressure sensor to correct a result of a determination made by the torque command value calculation section.

5. The construction machine according to claim 1, further comprising:

a first operation sensor that detects a swing operation amount signal of the first operation lever device; and a second operation sensor that detects a boom raising operation amount signal of the second operation lever device, wherein the torque command value calculation section includes:

an electric driving torque calculation section that calculates electric driving torque of the swing electric motor using the swing operation amount signal of the first operation lever device;

a combined operation determination section that determines whether a combined operation involving swing and boom raising is being performed using the swing operation amount signal of the first operation lever device and the boom raising operation amount signal of the second operation lever device;

a gain calculation section that calculates gain using the swing operation amount signal of the first operation lever device and the boom raising operation amount signal of the second operation lever device; and a torque command value correction section that, when the combined operation determination section determines that the combined operation involving swing and boom raising is not being performed, sets the electric driving torque calculated by the electric driving torque calculation section as a torque command value to be output to the inverter, and when the combined operation determination section determines that the combined operation involving swing and boom raising is being performed, sets, as the torque command value to be output to the inverter, a value obtained by multiplying the electric driving torque calculated by the electric driving torque calculation section by the gain calculated by the gain calculation section, the gain calculation section performs processing of calculating an estimated value of the load pressure of the swing hydraulic motor using the swing operation amount signal of the first operation lever device, processing of calculating an estimated value of the load pressure of the boom cylinder using the boom raising operation amount signal of the second operation lever device, and processing of calculating a positive gain when the estimated value of the load pressure of the swing hydraulic motor is smaller than the estimated value of the load pressure of the boom cylinder and calculating a negative gain when the estimated value of the load pressure of the swing hydraulic motor is greater than the estimated value of the load pressure of the boom cylinder, and when the gain calculated by the gain calculation section is positive, the torque command value correction section calculates the torque command value of the electric driving torque of the swing electric motor by multiplying the electric driving torque calculated by the electric driving torque calculation section by the positive gain, and when the gain calculated by the gain calculation section is negative, the torque command value correction section calculates the torque command value of the electricity generating torque of the swing electric motor by multiplying the electric driving torque calculated by the electric driving torque calculation section by the negative gain.

6. The construction machine according to claim 5, wherein, when the estimated value of the load pressure of the swing hydraulic motor is greater than the estimated value of the load pressure of the boom cylinder, the gain calculation section performs calculation such that an absolute value of the negative gain increases with increasing differential pressure between the estimated value of the load pressure of the swing hydraulic motor and the estimated value of the load pressure of the boom cylinder.

7. The construction machine according to claim 5, further comprising:

a first pressure sensor that detects load pressure of the swing hydraulic motor, wherein the controller further includes a load correction section that calculates limiting gain from a detection value of the load pressure of the swing hydraulic motor using a limiting gain calculation table and that corrects the gain by selecting either the limiting gain or the gain calculated by the gain calculation section, and when the combined operation determination section determines that the combined operation involving swing and boom raising is being performed, the torque command value correction section sets, as the torque command value to be output to the inverter, a value obtained by multiplying the electric driving torque calculated by the electric driving torque calculation section by the gain corrected by the load correction section.

8. The construction machine according to claim 5, further comprising:

a first pressure sensor that detects load pressure of the swing hydraulic motor; and a second pressure sensor that detects load pressure of the boom cylinder, wherein the controller further includes a load correction section that includes:

a loading state determination section that determines a loading state of the bucket using a detection value of the load pressure of the boom cylinder; and a gain correction section that selects one limiting gain calculation table from among a plurality of limiting gain calculation tables according to a result of a determination made by the loading state determination section, calculates limiting gain from a detection value of the load pressure of the swing hydraulic motor using the selected limiting gain calculation table, and corrects gain by selecting either the limiting gain or the gain calculated by the gain calculation section, and when the combined operation determination section determines that the combined operation involving swing and boom raising is being performed, the torque command value correction section sets, as the torque command value to be output to the inverter, a value obtained by multiplying the electric driving torque calculated by the electric driving torque calculation section by the gain corrected by the gain correction section.

9. The construction machine according to claim 8, further comprising:

a relief valve disposed in a line between the first hydraulic pump and the swing hydraulic motor, wherein the relief valve has relief pressure set to a value identical to a value of the load pressure of the boom cylinder when the loading state of the bucket is a loaded state during a boom raising operation, and when the loading state determination section determines that the loading state is an empty state and the detection value of the load pressure of the swing hydraulic motor is the relief pressure of the relief valve, the gain correction section calculates the limiting gain to be smaller than zero and, when the loading state determination section determines that the loading state is the loaded state and the detection value of the load pressure of the swing hydraulic motor is the relief pressure of the relief valve, the gain correction section calculates the limiting gain to be zero.

10. The construction machine according to claim 1, further comprising:

a first operation sensor that detects a swing operation amount signal of the first operation lever device;

a second operation sensor that detects a boom raising operation amount signal of the second operation lever device;

a first pressure sensor that detects load pressure of the swing hydraulic motor; and a second pressure sensor that detects load pressure of the boom cylinder, wherein the torque command value calculation section includes:

an electric driving torque calculation section that calculates electric driving torque of the swing electric motor using the swing operation amount signal of the first operation lever device;

a combined operation determination section that determines whether a combined operation involving swing and boom raising is being performed using the swing operation amount signal of the first operation lever device and the boom raising operation amount signal of the second operation lever device;

a loading state determination section that determines a loading state of the bucket using a detection value of the load pressure of the boom cylinder;

a gain calculation section that selects one gain calculation table from among a plurality of gain calculation tables according to a result of a determination made by the loading state determination section and calculates gain from a detection value of the load pressure of the swing hydraulic motor using the selected gain calculation table; and a torque command value correction section that, when the combined operation determination section determines that the combined operation involving swing and boom raising is not being performed, sets the electric driving torque calculated by the electric driving torque calculation section as a torque command value to be output to the inverter, and when the combined operation determination section determines that the combined operation involving swing and boom raising is being performed, sets, as the torque command value to be output to the inverter, a value obtained by multiplying the electric driving torque calculated by the electric driving torque calculation section by the gain calculated by the gain calculation section, when the loading state determination section determines that the loading state is an empty state and the detection value of the load pressure of the swing hydraulic motor is smaller than a predetermined value, the gain calculation section calculates positive gain, when the loading state determination section determines that the loading state is the empty state and the detection value of the load pressure of the swing hydraulic motor is greater than the predetermined value, the gain calculation section calculates negative gain, and when the loading state determination section determines that the loading state is a loaded state, the gain calculation section calculates gain so as to be greater than gain calculated when the loading state determination section determines that the loading state is the empty state with the detection value of the load pressure of the swing hydraulic motor being identical, and when the gain calculated by the gain calculation section is positive, the torque command value correction section calculates the torque command value of the electric driving torque of the swing electric motor by multiplying the electric driving torque calculated by the electric driving torque calculation section by the positive gain, and when the gain calculated by the gain calculation section is negative, the torque command value correction section calculates the torque command value of the electricity generating torque of the swing electric motor by multiplying the electric driving torque calculated by the electric driving torque calculation section by the negative gain.

11. The construction machine according to claim 1, further comprising:

a first operation sensor that detects a swing operation amount signal of the first operation lever device;

a second operation sensor that detects a boom raising operation amount signal of the second operation lever device;

a first pressure sensor that detects load pressure of the swing hydraulic motor; and a second pressure sensor that detects load pressure of the boom cylinder, wherein the torque command value calculation section includes:

an electric driving torque calculation section that calculates electric driving torque of the swing electric motor using the swing operation amount signal of the first operation lever device;

a combined operation determination section that determines whether a combined operation involving swing and boom raising is being performed using the swing operation amount signal of the first operation lever device and the boom raising operation amount signal of the second operation lever device;

an electricity generating torque calculation section that, when a detection value of the load pressure of the swing hydraulic motor is greater than a detection value of the load pressure of the boom cylinder, calculates differential pressure between the detection value of the load pressure of the swing hydraulic motor and the load pressure of the boom cylinder and, using the differential pressure, calculates electricity generating torque of the swing electric motor; and a torque command value changeover section that, when the combined operation determination section determines that the combined operation involving swing and boom raising is not being performed, selects the electric driving torque calculated by the electric driving torque calculation section as a torque command value to be output to the inverter and, when the combined operation determination section determines that the combined operation involving swing and boom raising is being performed, selects the electricity generating torque calculated by the electricity generating torque calculation section as the torque command value to be output to the inverter.

12. The construction machine according to claim 11, wherein the electricity generating torque calculation section performs calculation such that an absolute value of the electricity generating torque of the swing electric motor increases with increasing differential pressure between the detection value of the load pressure of the swing hydraulic motor and the detection value of the load pressure of the boom cylinder.

13. The construction machine according to claim 4, wherein the first pressure sensor detects delivery pressure of the first hydraulic pump as the load pressure of the swing hydraulic motor, and the second pressure sensor detects delivery pressure of the second hydraulic pump as the load pressure of the boom cylinder.

* * * * *